US008670513B2

(12) United States Patent
Stokely et al.

(10) Patent No.: US 8,670,513 B2
(45) Date of Patent: Mar. 11, 2014

(54) PARTICLE BEAM TARGET WITH IMPROVED HEAT TRANSFER AND RELATED APPARATUS AND METHODS

(75) Inventors: Matthew Hughes Stokely, Raleigh, NC (US); Bruce W. Wieland, Chapel Hill, NC (US)

(73) Assignee: BTI Targetry, LLC, Cary, NC (US)

( * ) Notice: Subject to any disclaimer, the term of this patent is extended or adjusted under 35 U.S.C. 154(b) by 751 days.

(21) Appl. No.: 12/434,002

(22) Filed: May 1, 2009

(65) Prior Publication Data

US 2010/0278293 A1 Nov. 4, 2010

(51) Int. Cl.

| | |
|---|---|
| ***G21G 1/04*** | (2006.01) |
| ***H05H 6/00*** | (2006.01) |
| ***G21K 5/08*** | (2006.01) |
| ***G21C 23/00*** | (2006.01) |

(52) U.S. Cl.

USPC ..... 376/202; 376/190; 376/342

(58) Field of Classification Search

None

See application file for complete search history.

(56) References Cited

U.S. PATENT DOCUMENTS

| | | | | |
|---|---|---|---|---|
| 2,113,116 | A | 4/1938 | McMillan | 415/128 |
| 2,868,987 | A | 1/1959 | Salsig, Jr. et al. | 250/428 |
| 3,262,857 | A | 7/1966 | Schlicht et al. | 376/325 |
| 3,349,001 | A | 10/1967 | Myles | 376/193 |
| 3,860,457 | A | 1/1975 | Vourinen et al. | 148/614 |
| 3,966,547 | A | 6/1976 | Blue | 376/192 |
| 4,752,432 | A | 6/1988 | Bida et al. | 376/195 |
| 4,818,468 | A | 4/1989 | Jungerman et al. | 376/195 |
| 4,843,246 | A | 6/1989 | Benes et al. | |
| 4,913,631 | A | 4/1990 | Vandendorpe | 417/355 |
| 4,990,787 | A | 2/1991 | Vanderheyden et al. | 250/432 |
| 5,280,505 | A | 1/1994 | Hughey et al. | 376/156 |
| 5,345,477 | A | 9/1994 | Wieland et al. | 376/195 |
| 5,355,394 | A | 10/1994 | van Geel et al. | 376/189 |
| 5,392,319 | A | 2/1995 | Eggers | 376/194 |

(Continued)

FOREIGN PATENT DOCUMENTS

| | | |
|---|---|---|
| EP | 0 752 710 A1 | 1/1997 |
| EP | 1 509 925 B1 | 1/2008 |

(Continued)

OTHER PUBLICATIONS

International Search Report and Written Opinion From Corresponding PCT Application No. PCT/US2009/042508, Jan. 26, 2010 (10 pgs).

(Continued)

*Primary Examiner* — Johannes P Mondt

(74) *Attorney, Agent, or Firm* — David P. Gloekler

(57) ABSTRACT

A particle beam target for producing radionuclides includes a target body, a target cavity, parallel grooves, peripheral bores, and radial outflow bores. The parallel grooves are formed in a back side of the target body and include respective first and second groove ends. The peripheral bores extend through the target body from the plurality of grooves generally toward the front side that receives a particle beam. Each groove communicates with a peripheral bore at the first groove end and another peripheral bore at the second groove end. The radial outflow bores extend radially from the plurality of peripheral bores. The target body defines a plurality of liquid coolant flow paths. Each liquid coolant flow path runs from a respective groove to at least one of the first groove end and the second groove end of the respective groove, through at least one peripheral bore, and through at least one radial outflow bore.

46 Claims, 14 Drawing Sheets

(56) References Cited

U.S. PATENT DOCUMENTS

| | | | | |
|---|---|---|---|---|
| 5,425,063 | A | 6/1995 | Ferrieri et al. | 376/195 |
| 5,468,355 | A | 11/1995 | Shefer et al. | 204/157.2 |
| 5,586,153 | A | 12/1996 | Alvord | 376/196 |
| 5,917,874 | A | 6/1999 | Schlyer et al. | 376/195 |
| 6,130,926 | A | 10/2000 | Amini | 376/194 |
| 6,190,119 | B1 | 2/2001 | Roth et al. | 415/55.7 |
| 6,567,492 | B2 | 5/2003 | Kiselev et al. | 376/195 |
| 6,717,162 | B1 | 4/2004 | Jongen | |
| 7,127,023 | B2 | 10/2006 | Wieland | 376/195 |
| 7,200,198 | B2 | 4/2007 | Wieland et al. | 376/195 |
| 7,512,206 | B2 | 3/2009 | Wieland | 376/195 |
| 2003/0007588 | A1 | 1/2003 | Kiselev et al. | 376/194 |
| 2004/0217304 | A1 | 11/2004 | Veneklasen et al. | |
| 2005/0084055 | A1* | 4/2005 | Alvord et al. | 376/194 |
| 2005/0201504 | A1* | 9/2005 | Zeisler et al. | 376/156 |
| 2010/0046689 | A1* | 2/2010 | Uhland | 376/151 |

FOREIGN PATENT DOCUMENTS

| | | | |
|---|---|---|---|
| EP | 1 575 488 | B1 | 1/2008 |
| WO | WO 97/09724 | A | 3/1997 |
| WO | WO 01/41154 | A1 | 6/2001 |

OTHER PUBLICATIONS

Lindner et al., "A Dynamic 'Loop'—Target for the In-Cyclotron Production of $^{18}$F by the $^{16}$O(α, d)$^{16}$F Reaction on Water", *International Journal of Applied Radiation and Isotopes*, vol. 24, pp. 124-126 (1973).

Shaeffer et al., "Design of a $^{18}$F Production System at ORNL 86-Inch Cyclotron," ORNL/MIT-258 (Oct. 19, 1977).

Chu et al., "Design of a Fluorine-18 Production System at ORNL Cyclotron Facility, Part 2", ORNL/MIT-262 (Nov. 28, 1977).

Wieland B. W. and Wolf A. P.; "Large Scale Production and Recovery of Aqueous F-18 Fluoride Using Proton Bombardment of a Small vol. O-18 Water Target", *Journal of Nuclear Medicine*, vol. 24, No. 5, p. 122 (May 1983).

Keinonen et al., "Effective Small-Volume [$^{18}$O]Water Target for the Production of [$^{18}$F]Fluoride", Appl. Radiat. Isot., vol. 37, No. 7, pp. 631-632 (1986).

Wieland B. W., Hendry G. O. and Schmidt D. G., "Design and Performance of Targets for Producing C-11, N-13, O-15 and F-18 with 11 MeV Protons", Paper 72, pp. 159-161, *6th Int'l Symposium on Radiopharmaceutical Chemistry*, Boston, MA Jun. 29-Jul. 3, 1986, J Label. Comp. Radiopharm, 23:1187 (1986).

Wieland B. W., Hendry G. O., Schmidt D. G., Bida G. T. and Ruth T. J., "Efficient Small vol. O-18 Water Targets for Producing F-18 fluoride with Low Energy Protons", Paper 78, pp. 177-179, *6th Int'l Symposium on Radiopharmaceutical Chemistry*, Boston, MA Jun. 29-Jul. 3, 1986, J Label. Comp. Radiopharm, 23:1205 (1986).

Wieland B. W., Schmidt D. G., Bida G. T., Ruth T. J. and Hendry G. O., "Efficient Economical Production of Oxygen-15 Labeled Tracers with Low Energy Protons", Paper 82, pp. 186-187, *6th Int'l Symposium on Radiopharmaceutical Chemistry*, Boston, MA Jun.29-Jul. 3, 1986, J Label. Comp. Radiopharm, 23:1214 (1986).

Ruth T. J., Helus F. and Wieland B., "A Report on the Heidelberg Targetry Workshop", *6th Int'l Symposium on Radiopharmaceutical Chemistry*, Boston, MA Jun. 29-Jul. 3, 1986, Paper 160, pp. 368-369 (1986).

Wieland B. W., "A negative ion cyclotron using 11 MeV protons for the production of radionuclides for clinical positron tomography", in Helus F and Ruth TJ, eds., *Proceedings of the first workshop on targetry and target chemistry*(1985), DKFZ Press, Heidelberg, Germany, pp. 119-125 (1987).

Iwata et al., "[$^{18}$F]Fluoride Production with a Circulating [$^{18}$O]Water Target," *Appl. Radiation Isot.*, vol. 38, No. 11, pp. 979-984 (1987).

Wieland B. W. and Hendry G. O., "Cyclotron Targets for Routine Production of F-18 Fluoride and O-15 oxygen with an 11 MeV Proton Cyclotron", in Ruth TJ, McQuarrie SA and Helus F, eds., *Proceedings of the second workshop on targetry and target chemistry*(1987), DKFZ Press, Heidelberg, Germany, pp. 58-62 (1989).

Wieland B. W., Bida G. T., Padgett H. C. and Hendry G. O., "Current Status of CTI Target Systems for the Production of PET Radiochemicals", in Ruth TJ, ed., *Proceedings of the third workshop on targetry and target chemistry*(1989), TRIUMF Press, Vancouver, pp. 34-48 (1990).

Harris C. C., Need J. L., Dew V. D., Dailey M. F., Coleman R. E., Padgett H. C. and Wieland B. W., "Successful Production of F-18 Fluorodeoxyglucose Using F-18 Ion Produced in an Nickel-Plated Copper Target", in *Proceedings of the third workshop on targetry and target chemistry*(1989), TRIUMF Press, Vancouver, p. 66 (1990).

Wieland B. W., Alvord C. W., Bida G. T. and Hendry G. O., "New Liquid Target Systems for the Production of [Fluorine-18]Fluoride Ion and [Nitrogen-13]Ammonium Ion with 11 MeV Protons", *Targetry '91, proceedings of the fourth workshop on targetry and target chemistry*, Villigen, Switzerland, PSI Proceedings 92-01, pp. 117-122 (1992).

Wieland B. W., McKinney C. J. and Dailey M. F., "Utilization of the CS-30 Cyclotron at the Duke University Medical Center", in *Proceedings of the fifth int'l workshop on targetry and target chemistry* (Sep. 19 to 23, 1993) at Brookhaven National Laboratory and Northshore University Hospital, Long Island, NY, BNL-61149, p. 359 (1995).

Wieland B., Illan C., Doster M., Roberts A., Runkle R., Rowland C. And Bida J., "Self-Regulating Thermosyphon Water Target for Production of F-18-Fluoride at Proton Beam Power of One kW and Beyond", *Proceedings of the Ninth International Workshop on Targetry and Target Chemistry*, Turku, Finland, pp. 19-20 (May 23-25, 2002).

Wieland B. and Wright B., Regenerative Turbine Pump Recirculating Water Target for Producing F-18-Fluoride Ion with Several kW Proton Beams, *Proceedings of the Ninth International Workshop on Targetry and Target Chemistry*, Turku, Finland, pp. 21-22 (May 23-25, 2002).

Wieland B. W., Wright B. C., Bida G. T., Illan C. D., Doster J. M., Clark J. C. and Runkle R. C., "Thermosyphon Batch and Regenerative Turbine Recirculating $^{18}$O(p,n)$^{18}$F Water Targets for Operation at High Beam Power", *10th Workshop on Targetry and Target Chemistry*, Madison, Wisconsin, p. 26 (Aug. 13-15, 2004).

* cited by examiner

PARTICLE BEAM TARGET WITH IMPROVED HEAT TRANSFER AND RELATED APPARATUS AND METHODS

TECHNICAL FIELD

The present invention relates generally to particle beam targets utilized for producing radionuclides. More particularly, the present invention relates to the cooling of targets during irradiation by a particle beam.

BACKGROUND

Radionuclides may be produced by bombarding a target with an accelerated particle beam as may be generated by a cyclotron, linear accelerator, or the like. The target contains a small amount of target material that is typically provided in the liquid phase but could also be a solid or gas. The target material includes a precursor component that is synthesized to the desired radionuclide in reaction to irradiation by the particle beam. As but one example, F-18 ions may be produced by bombarding a target containing water enriched with the 0-18 isotope with a proton beam. After bombardment, the as-synthesized F-18 ions may be recovered from the water after removing the water from the target. The production of F-18 ions in particular has important radiopharmaceutical applications. For instance, the as-produced F-18 ions may be utilized to produce the radioactive sugar fluorodeoxyglucose (2-fluoro-2-deoxy-D-glucose, or FDG), which is utilized in positron emission tomography (PET) scanning. PET is utilized in nuclear medicine as a metabolic imaging modality in the diagnosis of cancer.

The production of radionuclides such as F-18 ions is an expensive process, and thus any improvement to the production efficiency and yield would be desirable. Unfortunately, the application of the particle beam initiates the desired nuclear reaction in only a very small fraction of the radionuclide precursors in the target. The particle beam deposits a significant amount of heat into the target material residing in the target during bombardment. For instance, in the conventional production of F-18 ions, it has been found that only about one of every 2,000 protons stopping in the target water actually produces the desired nuclear reaction, with the rest of the proton beam merely depositing heat. Yet the amount of radioactive product that can be produced in a radionuclide target is proportional to the amount of heat that can be removed during bombardment of the target material of choice. The heat energy deposited in the target material may cause boiling and generate bubbles or voids in the volume of target material. Bubbles or voids do not yield radionuclides; the particle beam simply passes through the bubbles or voids to the back of the target structure. Moreover, the rapidly increasing vapor pressure developed in the target chamber containing the target material as a result of the heat deposition may cause the target to structurally fail if the heat deposition is not adequately removed.

Radionuclide production yield could be increased by increasing the beam energy inputted to the target, but due to the foregoing problems the beam energy has been intentionally limited in conventional systems. Conventional radionuclide production systems may provide a means for cooling the beam targets generally by routing a heat transfer medium such as water to the target to carry heat away therefrom during bombardment. Conventional target designs, however, do not have sufficient capacity for heat removal, and as a result the radionuclide production yield and efficiency has been less than desirable in conventional targets.

In view of the foregoing, there is an ongoing need for beam targets utilized for radionuclide production that enable increased capacity and efficiency for removing heat and thus improved radionuclide production yield and efficiency.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, a particle beam target includes a target body, a target cavity, a plurality of parallel grooves, a plurality of peripheral bores, and a plurality of radial outflow bores. The target body includes a front side, a back side and a lateral outer wall extending from the front side to the back side. The target cavity is disposed in the target body and includes a back inner wall, a lateral inner wall, and a cross-section bounded by the lateral inner wall. The back inner wall is spaced from the back side relative to a lateral axis, and the lateral inner wall extends from the back inner wall toward the front side generally along the direction of the lateral axis. The parallel grooves are formed in the back side. Each groove includes a first groove end and a second groove end and runs along a transverse direction from the first groove end to the second groove end, the transverse direction being orthogonal to the lateral direction. The peripheral bores extend through the target body from the plurality of grooves generally toward the front side. The peripheral bores are arranged to circumscribe the target cavity cross-section in proximity to the lateral inner wall, wherein each groove fluidly communicates with at least one peripheral bore at the first groove end and at least one other peripheral bore at the second groove end. The radial outflow bores extend in respective radial directions relative to the lateral axis from the plurality of peripheral bores to the lateral outer wall, each radial outflow bore fluidly communicating with at least one of the peripheral bores. The target body defines a plurality of liquid coolant flow paths. Each liquid coolant flow path runs from a respective groove to at least one of the first groove end and the second groove end of the respective groove, through at least one peripheral bore, through at least one radial outflow bore, and to the lateral outer wall.

According to another implementation, method is provided for cooling a particle beam target. The particle beam target includes a target cavity for containing a target material and is capable of receiving a particle beam for producing radionuclides from the target material. In the method, a coolant is flowed to a back side of the particle beam target, the back side being opposite to a front side of the target at which the particle beam is received. The coolant is divided into a plurality of coolant input flows in a corresponding plurality of grooves disposed at the back side, the grooves running in a transverse direction. In each groove, the coolant input flow is split into a first transverse coolant flow path directed along the transverse direction toward a first groove end and a second transverse coolant flow path directed along an opposite transverse direction toward a second groove end. In each groove, the coolant in the first transverse coolant flow path is diverted into a peripheral bore and the second transverse coolant flow path is diverted into another peripheral bore. Each peripheral bore is part of a plurality of peripheral bores running from respective first or second groove ends toward the front side, and the plurality of peripheral bores circumscribe the target cavity. The coolant flows from each first transverse coolant flow path and second transverse coolant flow path into a corresponding lateral coolant flow path directed along a lateral direction generally orthogonal to the transverse direction. The coolant in the plurality of peripheral bores is diverted into a plurality of radial outflow bores located at an end of the peripheral bores opposite to the plurality of first groove ends and second groove ends along the lateral direction, wherein the coolant flows from each lateral coolant flow path into one of a plurality of radial coolant flow paths running through the respective radial outflow bores along a radial direction generally orthogonal to the lateral direction and directed away from the target cavity. While flowing the coolant through the plurality of first transverse coolant flow paths, second transverse coolant flow paths, lateral coolant flow paths and radial coolant flow paths, heat is removed from the target material contained in the target cavity.

According to another implementation, a particle beam target includes a target body, a target cavity, a channel, a plurality of peripheral bores, and a plurality of radial outflow bores. The target body includes a front side, a back side, and a lateral outer wall extending from the front side to the back side. The target cavity is disposed in the target body and is bounded by a lateral inner wall of the target body. The lateral inner wall is disposed about a lateral axis and extends from a target cavity opening at the front side toward the back side. The channel is formed at the front side and circumscribes the target cavity opening. The peripheral bores extend through the target body from the back side toward the front side. The peripheral bores circumscribe the target cavity in proximity to the lateral inner wall, wherein the peripheral bores are arranged along a peripheral bore perimeter at a radial distance between the target cavity and the channel relative to the lateral axis. The radial outflow bores extend in respective radial directions relative to the lateral axis from the plurality of peripheral bores to the lateral outer wall. Each radial outflow bore fluidly communicates with at least one of the peripheral bores. The target body defines a plurality of liquid coolant flow paths, each liquid coolant flow path running through at least one peripheral bore, through at least one radial outflow bore, and to the lateral outer wall.

According to another implementation, a particle beam target includes a target body, a target cavity, a plurality of peripheral bores, and a plurality of radial outflow bores. The target body includes a front side, a back side, and a lateral outer wall extending from the front side to the back side. The target cavity is disposed in the target body and is bounded by a lateral inner wall of the target body. The lateral inner wall is disposed about a lateral axis and extends from a target cavity opening at the front side toward the back side. The peripheral bores extend through the target body from the back side toward the front side and circumscribe the target cavity. The target body further includes an annular portion interposed between the lateral inner wall and the peripheral bores. The annular portion has a radial thickness between the lateral inner wall and the peripheral bores ranging from, for example, 0.002 inch to 0.5 inch. The radial outflow bores extend in respective radial directions relative to the lateral axis from the plurality of peripheral bores to the lateral outer wall. Each radial outflow bore fluidly communicates with at least one of the peripheral bores. The target body defines a plurality of liquid coolant flow paths, each liquid coolant flow path running through at least one peripheral bore, through at least one radial outflow bore, and to the lateral outer wall.

According to another implementation, a particle beam target includes a target body, a target cavity, a target window, a plurality of peripheral bores, and a plurality of radial outflow bores. The target body includes a front side, a back side, and a lateral outer wall extending from the front side to the back side. The target cavity is disposed in the target body and is bounded by a lateral inner wall of the target body. The lateral inner wall is disposed about a lateral axis and extends from a target cavity opening at the front side toward the back side. The target window is disposed at the front side and covers the target cavity opening. The peripheral bores extend through the target body from the back side toward the front side. The peripheral bores circumscribe the target cavity in proximity to the lateral inner wall. The peripheral bores are arranged along a peripheral bore perimeter at a radial distance between the target cavity and an outer perimeter of the target window relative to the lateral axis. The radial outflow bores extend in respective radial directions relative to the lateral axis from the plurality of peripheral bores to the lateral outer wall. Each radial outflow bore fluidly communicates with at least one of the peripheral bores. The target body defines a plurality of liquid coolant flow paths, each liquid coolant flow path running through at least one peripheral bore, through at least one radial outflow bore, and to the lateral outer wall.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

By way of example, FIGS. 1-13 illustrate various implementations of a target and associated radionuclide production apparatus or system. The various implementations provide a highly efficient solution for cooling a target cavity containing target material bombarded by particles (e.g., protons) for the purpose of obtaining a maximum amount of heat removal from the target material and thereby maximizing the amount of radioactive product that can be produced from that target material. As noted above, the amount of radioactive product that can be produced in a radionuclide target is proportional to the amount of heat that can be removed during bombardment of the target material of choice. In various implementations, a high rate of heat removal is accomplished at least in part by providing numerous individual, high-velocity, multi-stage coolant flow paths arranged in parallel and closely spaced to each other and in close proximity to the target cavity containing the target material to be cooled. This configuration maximizes the heat flow from the target medium to the coolant by minimizing the heat conduction distance (i.e., the thickness of the target structure across which the heat must be transferred). The target may be implemented in connection with any type of liquid coolant and any type of radionuclide synthesis process. A target consistent with the present teaching has experimentally demonstrated superior performance in transferring heat away from target material, as compared to conventional targets.

Figure 1:
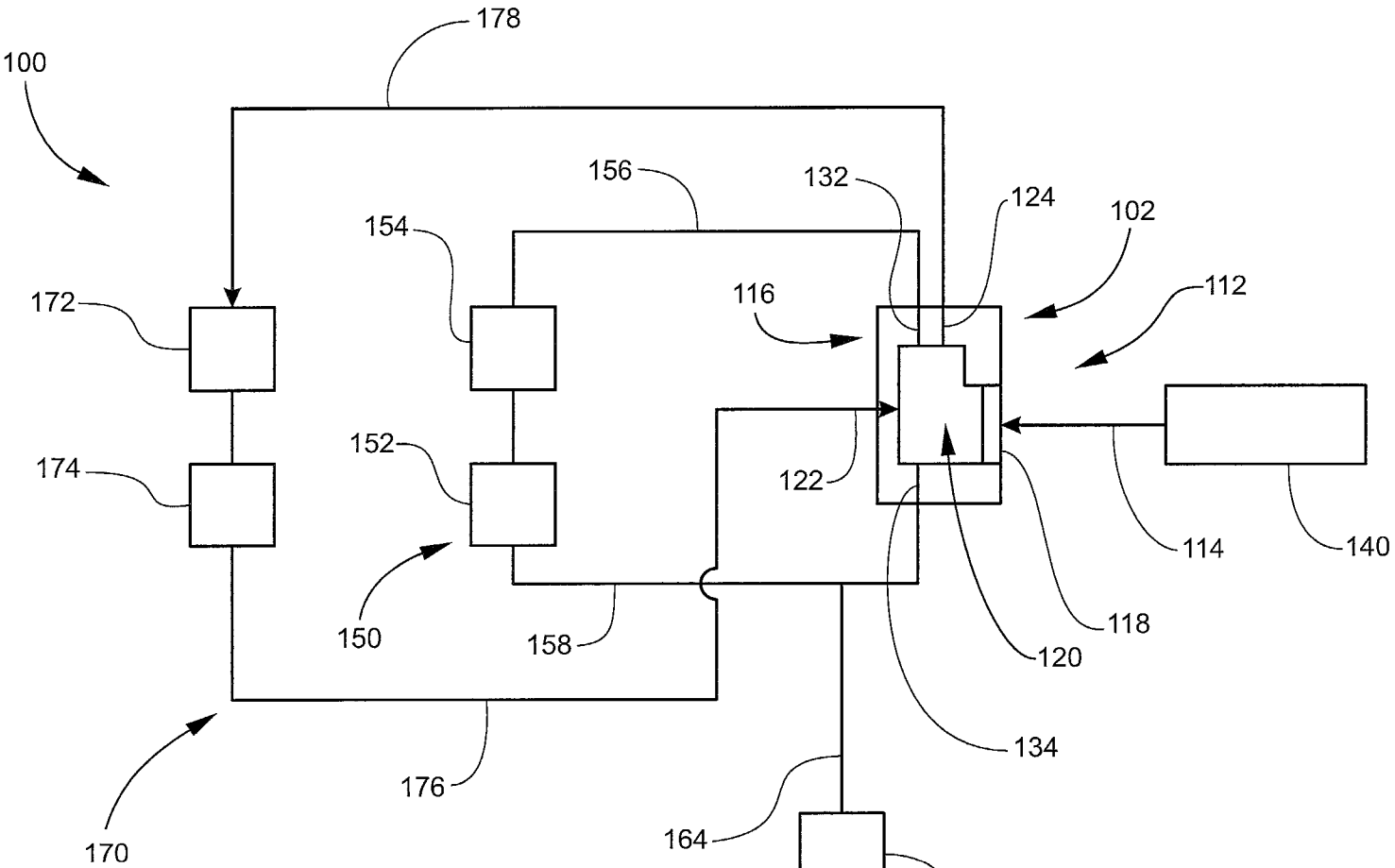
FIG. 1 is a simplified schematic view of an example of a radionuclide production apparatus or system as an example of an operating environment in which a target according to the present teachings may be implemented.

FIG. 1 is a simplified schematic view of an example of a radionuclide production apparatus or system 100 as an example of an operating environment in which a target 102 according to the present teachings may be implemented. The target 102 generally includes a front side (beam input side) 112 at which a particle beam 114 is directed and a back side (coolant input side) 116 which, in the presently described implementation, receives an input of any suitable liquid coolant (e.g., water). The target 102 also generally includes a target body that may include one or more parts assembled together. Insofar as the target 102 may include assembled components, the target 102 may also be referred to herein as a target assembly. The target 102 is typically constructed from a suitable metal or metal alloy, a few examples being silver, aluminum, gold, nickel, titanium, copper, platinum, tantalum, niobium, and stainless steel. At the front side 112, the target 102 includes a target window 118 of any material suitable for transmitting the particle beam 114 therethrough while minimizing loss of beam energy. Typically, the target window 118 is constructed from a metal or metal alloy, a few examples being the commercially available HAVAR® alloy, titanium, tantalum, tungsten, and gold. The thickness of the target window 118 may range, for example, from 0.3 to 30 μm. A target chamber or cavity 120 is formed within the target body and defines an interior of the target body into which the particle beam 114 is directed via the target window 118. In practice, the target cavity 120 contains a flowable target material that includes a radionuclide precursor, the composition of which will depend on the type of radionuclide being synthesized. As a non-limiting example, the internal volume (or size) of the target cavity 120 may range from 1.0 to 10 $cm^3$. A coolant inlet 122 and a coolant outlet 124 are also formed in the target body. The coolant inlet 122 and the coolant outlet 124 communicate with each other via a coolant flow system internal to the target body, as described in more detail below.

In some non-limiting examples, particularly where the target material is a liquid, the volume of the target cavity 120 after assembly of the target window 118 thereto ranges from 0.5 cc (or ml) to 20 cc. In other non-limiting examples, particularly where the target material is a solid, the volume of the target cavity 120 after assembly of the target window 118 thereto ranges from 0.1 cc to 20 cc. In other non-limiting examples, particularly where the target material is a gas, the volume of the target cavity 120 after assembly of the target window 118 thereto ranges from 100 cc to 10,000 cc (10 L).

One or more target material transfer bores may be formed in the target 102 for inputting target material into and/or outputting target material from the target cavity 120. In the present example, a target material inlet bore 132 and a separate target material outlet bore 134 are formed in the target body and fluidly communicate with the target cavity 120. The locations of the inlet bore 132 and the outlet bore 134 are arbitrary in the schematic view of the FIG. 1, and may depend on whether it is desired to load the target 102 with target material from the top or the bottom. For example, the inlet bore 132 may alternatively be located at the top of the target cavity 120 and the outlet bore 134 may be located at the bottom of the target cavity 120. As a further alternative, the target 102 may include a single bore 132 or 134 utilized for both introducing target material (including precursors) to the target cavity 120 and removing target material (including radionuclides) from the target cavity 120.

The illustrated example, in which a single fluid transfer bore 132 or 134 or both an inlet bore 132 and an outlet bore 134 are utilized, is directed primarily to the use of a liquid target material. It will be appreciated by persons skilled in the art that in other cases, such as where the target material is a solid or a gas, the inlet bore 132 and/or outlet bore 134 may be modified as necessary or not utilized at all. As one example of the use of a solid target material, molten target material could first be loaded into the target cavity 120 and allowed to solidify, and the target material is maintained in the solid phase during application of the particle beam due to the cooling provided by the present teachings.

The radionuclide production apparatus 100 includes a particle beam source 140 such as, for example, a cyclotron, a linear accelerator, or the like. The structure and operation of the particle beam source 140 may depend on the type of particle beam 114 utilized. As an example, the particle beam 114 may be a proton beam. The proton beam is typically applied at a beam power of about 0.5 kW or greater, up to a practical limit that avoids structural failure of the target 102 and impairment of the desired nuclear reaction. In conventional targets, the beam power typically does not exceed about 2 kW. In at least some implementations of the target 102 taught herein, it is expected that the beam power may be increased to about 10 kW or greater.

The radionuclide production apparatus 100 also includes a target material transport circuit or system 150. The target material transport system 150 may include any suitable target material source (supply, reservoir, etc.) 152, a device for moving the target material such as, for example, a pump 154, and a target material input line 156 for conducting the target material from the target material source 152 to the inlet bore 132 and thus the target cavity 120. The target material transport system 150 may be implemented as a loop, in which case the above-noted outlet bore 134 is included as well as a target material output line 158 that leads back to the target material source 152 or at least back to the pump 154. By utilizing the loop configuration, the target material may be flowed through the inlet bore 132, filling the target cavity 120, and through the outlet bore 134 prior to activation of the particle beam 114. In this manner, the target material transport system 150 may be utilized to purge the target cavity 120 of bubbles, gases, contaminants, or any other undesired components prior to application of the particle beam 114 and ensuing synthesis. In practice, the target cavity 120 may be filled from the top (in which case the inlet bore 132 may be located at the top, as in the illustrated example) or from the bottom (in which case the inlet bore 132 may be located at the bottom). The schematically illustrated positions of the target material source 152 and the pump 154 may be switched as needed for top-filling or bottom-filling.

In the present example, the target material transport system 150 may also be utilized to route as-produced radionuclides to a desired radionuclide destination 162 for further processing, such as a hot lab. For this purpose, a radionuclide output line 164 is schematically shown as fluidly communicating with the target material outlet line 158 (or, alternatively, with the target material inlet line 156). A valve or other controllable flow-diverting means (not shown) may serve as an interface between the target material transport system 150 and the radionuclide output line 164 for this purpose.

The radionuclide production apparatus 100 also includes a coolant circulation circuit or system 170. The coolant circulation system 170 may include any suitable coolant conditioning apparatus (heat exchanger, condenser, evaporator, and the like) 172 for providing coolant to the target 102, receiving heated coolant from the target 102, removing heat from the heated coolant, and repeating the cycle as needed during synthesis. The coolant circulation system 170 may also include a device for moving the coolant to and from the target 102 such as, for example, a pump 174, a coolant input line 176 for conducting the coolant from the coolant conditioning apparatus 172 to the coolant inlet 122 of the target 102, and a coolant output line 178 for conducting the heated coolant from the coolant outlet 124 of target 102 back to the coolant conditioning apparatus 172.

In practice, the target material source 152 is provided with a suitable supply of target material, and the target cavity 120 is loaded with a suitable amount of target material by flowing the target material from the target material source 152 into the target cavity 120. Once the target cavity 120 is filled (partially or entirely, depending on design) with a desired amount of target material, the particle beam source 140 is operated to generate a particle beam 114, which is directed into the target cavity 120 via the target window 118 for interaction with the target material. Application of the particle beam 114 results in synthesis of radionuclides from the target material in the target cavity 120. After a sufficient amount of time during the "beam-on" stage has elapsed, the particle beam 114 is switched off and the as-produced radionuclides are transported to the hot lab or other destination 162 for further processing.

As noted above, during application of the particle beam 114, a large amount of energy is deposited as heat in the target material residing in the target cavity 120. This heat generates a large amount of vapor within the target cavity 120 resulting in voids or bubbles within the target material. The voids or bubbles interfere with the particle beam's ability to cause the nuclear reaction needed for radionuclide synthesis, and the vapor pressure may quickly cause the target 102 to fail structurally. Hence, the heat must be rapidly removed from the target 102 and from the target material residing in the target 102. This is accomplished through the operation of the coolant circulation system 170 during application of the particle beam 114 in conjunction with a coolant circulation system incorporated into the target 102, as described by way of examples below.

A non-limiting example of radionuclide synthesis is the production of the F-18 ($^{18}F$) ion (fluorine-18) from the O-18 (oxygen-18) precursor. In this case, the target material may be provided as O-18 enriched water, i.e., water in which a desired fraction has the composition $H_2{}^{18}O$, and the particle beam is a proton beam. The nuclear reaction is specified as $^{18}O(p,n)^{18}F$. Other examples of radionuclides that may be produced include, but are not limited to, N-13, O-15, and C-11. N-13 is produced from natural water as the target material utilizing alpha-particles according to the nuclear reaction $^{16}O(p,\alpha)^{13}N$.

The target 102 disclosed herein is particularly suited for use as a "batch" or "static" target. In a batch or static target, the target material is loaded in the target cavity 120, the same amount of target material remains in the target cavity 120 during synthesis, and the target material (now including radionuclides) is thereafter removed from the target 102. An alternative type of target is a recirculating target, in which the target material is circulated through the target cavity 120 during application of the particle beam. In a recirculating target, the target material itself may be utilized as a heat transfer medium to some degree because the target material carries heat away from the target and, prior to being recirculated back to the target, may be cooled by a heat exchange system located remotely from and external to the target body. The present teachings, however, encompass the use of the target 102 disclosed herein as a recirculating target as an option for increasing the heat-removal capacity of the recirculating target.

Figure 2:
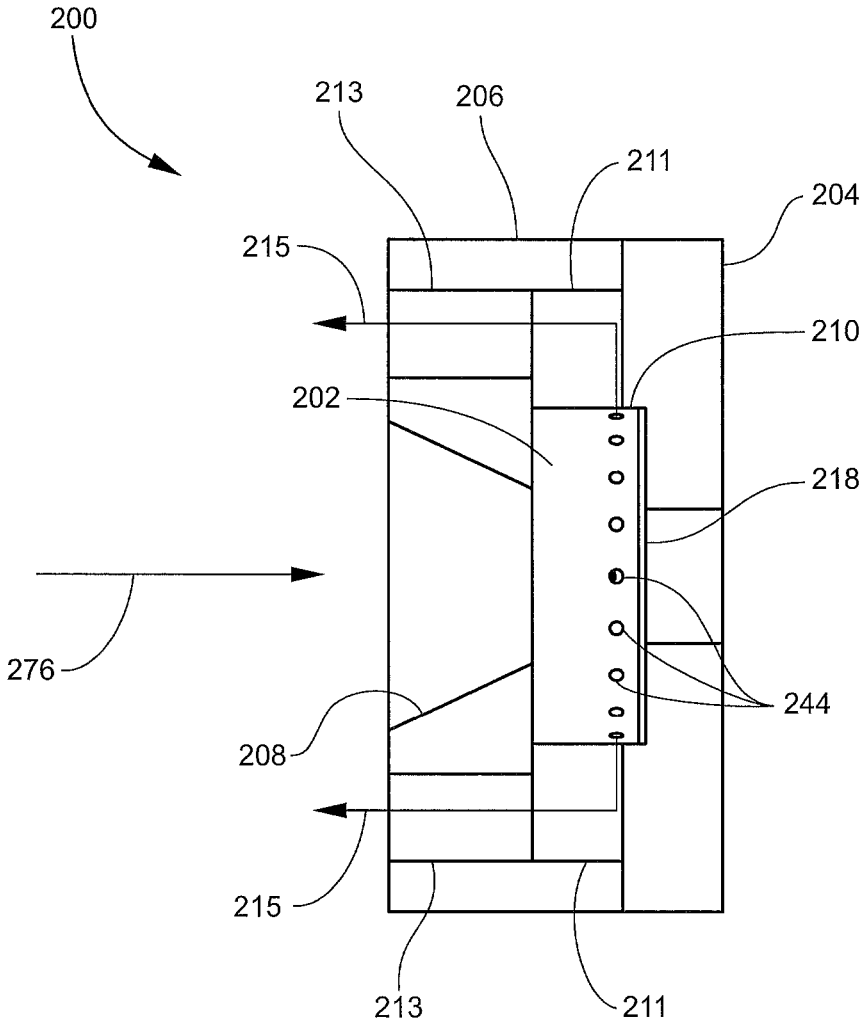
FIG. 2 is a side, partially cut-away view of an example of a target according to the present teachings.
Figure 3:
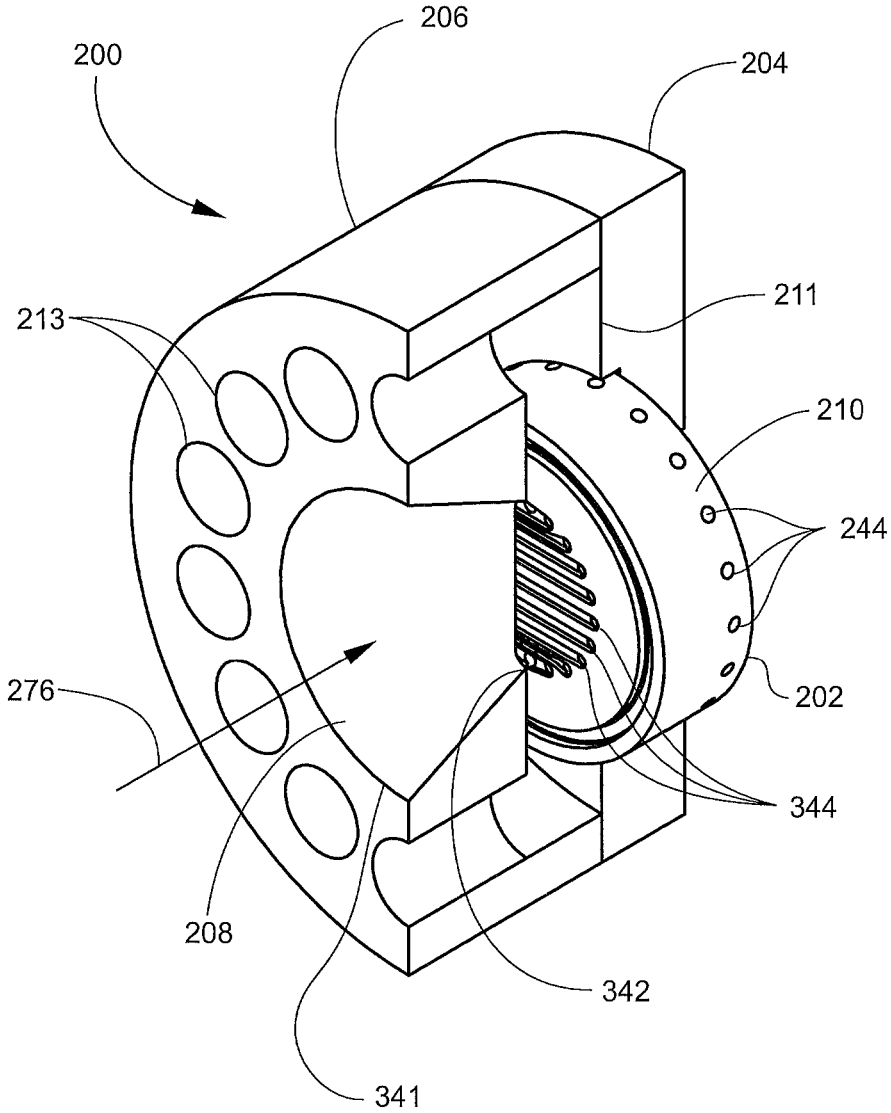
FIG. 3 is a perspective view of the back side of the target illustrated in FIG. 2.

FIG. 2 is a side, partially cut-away view of an example of a target 200 according to the present teachings, and FIG. 3 is a perspective view from the back side. The target 200 may be utilized in a radionuclide production system such as illustrated by example in FIG. 1, or in other, differently configured radionuclide production systems. The target 200 includes a target body 202 that may be mounted in a recess of a front target section 204. A target cavity and various coolant passages defining a plurality of coolant paths (not shown) are formed in the target body 202 as described below. The front target section 204 closes off the front side of the target cavity, and includes a target window 218 for receiving a particle beam 114 (FIG. 1) as described above. The front target section 204 abuts a medial target section 206 that surrounds the target body 202. The back side of the target 200 receives an input flow of coolant from a coolant input line 276 in a manner described below. In some implementations, an input plenum (or manifold, chamber, conduit, etc.) 208 of any suitable design is interposed between the coolant input line 276 and the back side of the target body 202 for receiving the input coolant. The input plenum 208 may be formed by a coolant inlet body or region of the medial target section 206 for distributing coolant to the back side of the target body 202 in a manner described below. In this example, a plurality of parallel grooves 344 (FIG. 3) is formed in the back side of the target body 202. The input plenum 208 may taper in the direction of the back side to direct the input coolant flow to the grooves 344. In the present example, the coolant outlet is implemented as a plurality of radial outflow bores 244 circumferentially distributed about the target body 202. The radial outflow bores 244 may terminate at a lateral outer wall 210 of the target body 202. The radial outflow bores 244 may fluidly communicate with one or more coolant output lines 178 (FIG. 1) to enable removal of heat from the target 200 and the target material residing in the target 200, as noted above. To facilitate routing the coolant from the radial outflow bores 244 to the coolant output line(s) 178, an output plenum of any suitable design may be provided. For this purpose, in the illustrated example the output plenum includes one or more chambers 211 and radially distributed axial bores 213 formed in the medial target section 206.

Figure 3A:
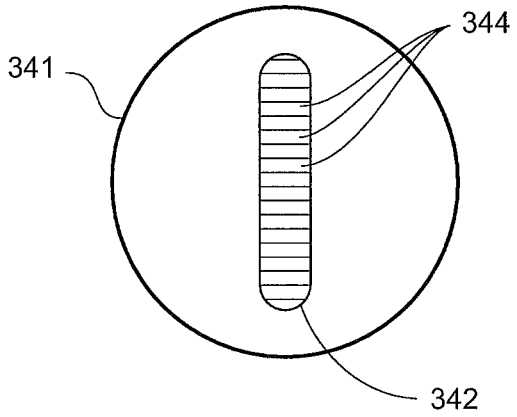
FIG. 3A is an elevation view of an entrance slot in front of the back side of the target.

Referring to FIG. 3, the input plenum 208 has an entrance 341 that may have any suitable shape and size. In this example, the input plenum 208 is shaped so as to transition to an elongated slot or slit 342 that serves as the entrance to the grooves 344 formed in the back side of the target body 202. FIG. 3A illustrates the elongated slot 342 in front of the grooves 344. A portion of these grooves 344 are visible through the elongated slot 342. The elongated slot 342 is oriented along a vertical direction in FIG. 3A. It will be understood, however, that the term "vertical" is relative to the perspective of FIG. 3A and that in practice no limitations are placed on the orientation of the target 200 or any of its components relative to any particular frame of reference. In the present example, the grooves 344 are oriented transversely relative to the elongated slot 342. Thus, in the example specifically illustrated in FIG. 3A, the grooves 344 may be characterized as being horizontal although again it will be understood that the term "horizontal" is utilized in a relative sense without any limitation being placed on a particular orientation for the grooves 344. The elongated slot 342 is dimensioned such that coolant flowing through the elongated slot 342 will be divided into each of the grooves 344. That is, all grooves 344 are exposed through the elongated slot 342 as shown in FIGS. 3 and 3A. Thus, for example, if fourteen grooves 344 are provided, the input flow of coolant passing through the elongated slot 342 will be divided into fourteen separate, individual input flow paths, with each input flow path being associated with a respective groove 344. In some embodiments, the elongated slot 342 is positioned at a point over each groove 344 equidistant to the first groove end and to the second groove end of the groove 344, and the coolant flow in the liquid coolant flow path for the respective groove 344 is divided approximately equally into the first liquid coolant flow path and the second liquid coolant flow path.

Figure 4:
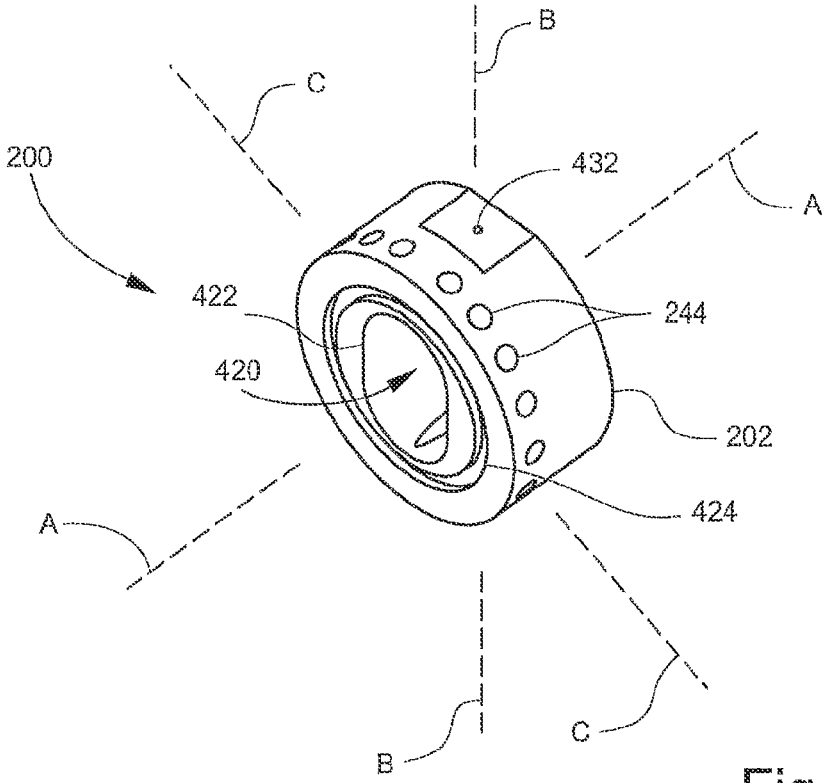
FIG. 4 is a perspective view of the front side of the target.

FIG. 4 is a perspective view of the front side of the target 200 (or at least the main target section 202) according to the presently described example. For reference purposes, FIG. 4 provides three mutually orthogonal axes that intersect at a point within the target 200 such as in a target cavity 420 thereof: a lateral axis A passing through the target cavity 420 from the front side to the back side, a longitudinal axis B passing through the target cavity 420 from the bottom to the top (from the perspective of FIG. 4), and a transverse axis C also passing through the target cavity 420. Also for reference purposes, the lateral axis A may be associated with a depth of the target 200, the longitudinal axis B may be associated with a length or height of the target 200, and the transverse axis C may be associated with a width of the target 200. This system of three reference axes A, B and C will be utilized in conjunction with FIGS. 5-10 as well.

As illustrated in FIG. 4, the target cavity 420 includes a lateral inner wall 422 that defines the cross-section of the target cavity 420 in the plane of the longitudinal axis B and the transverse axis C. The cross-section of the target cavity 420 may include an oblong section that adjoins a rounded top end and a rounded bottom end. That is, the target cavity 420 is elongated in the longitudinal direction. In the present example, the target cavity 420 may open at the front face of the target 200 and may be bounded by the front target section 204 (FIG. 2) after assembly. A channel 424 surrounding the target cavity may be formed in the front face for receiving a suitable gasket or other sealing component (not shown), thereby forming a fluid seal at the interface between the main target section 202 and the front target section 204. FIG. 4 also shows the circumferential series of radial outflow bores 244 that open at the outer surface of the main target section 202. In the present context, term "radial" is relative to the intersection point of the three reference axes A, B and C and is not intended to limit the target 200 as having a circular shape or any other particular shape. FIG. 4 also shows a target inlet (or outlet) bore 432. The target inlet bore 432 may open at a flat section to facilitate fluid connection with a fitting or other component.

Figure 5:
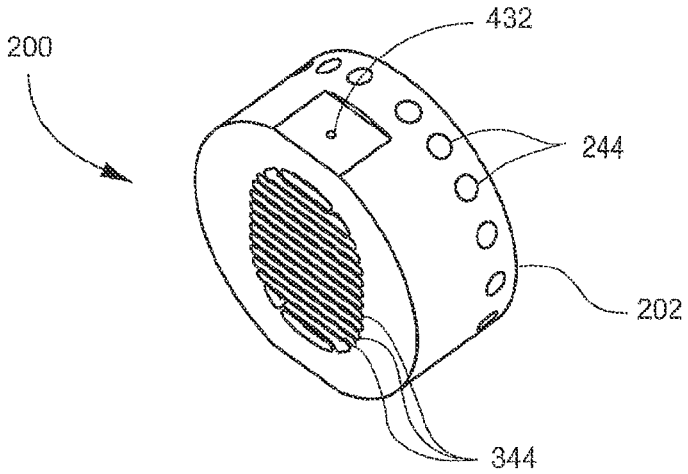
FIG. 5 is another perspective view of the back side of the target.

FIG. 5 is a perspective view of the back side of the target 200 (or at least the main target section 202) according to the present example. The plurality of transversely oriented grooves 344 is formed in the back face. The grooves 344 are adjacent to the target cavity 420 (FIG. 4). The respective widths of the grooves 344 are sized so as to be somewhat greater than the width of the cross-section of the target cavity 420 at all elevations of the target cavity 420. Accordingly, the grooves 344 may collectively exhibit the rounded and oblong shape of the target cavity 420 that characterizes the present example. As described in more detail below, the widths of the grooves 344 enable coolant to be routed in close proximity with the target cavity 420 in the lateral direction to maximize heat transfer from the target cavity 420.

Figure 6:
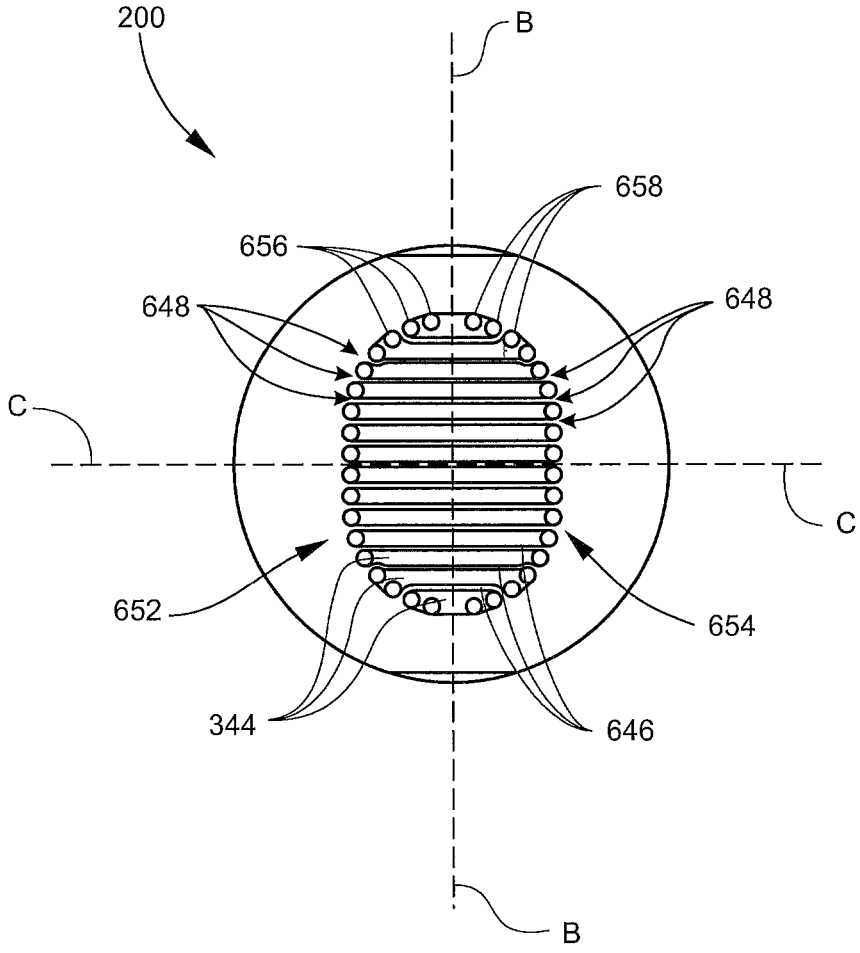
FIG. 6 is an elevation view of the front side of the target.

FIG. 6 is an elevation view of the back side of the target 200. Each groove 344 is separated from an adjacent groove 344 by a thin, transverse groove wall 646. Each groove 344 runs in the transverse direction between a first groove end 652 and an opposing second groove end 654. Each groove end 652 and 654 fluidly communicates with at least one peripheral bore 656 and 658. Some of the grooves 344 may communicate with more than one peripheral bore 656 and 658. Thus, the number of grooves 344 may be equal to half the number of peripheral bores 656 and 658, or less than half the number of peripheral bores 656 and 658. In the illustrated example, the upper two grooves 344 and the bottom two grooves 344 each communicate with two peripheral bores 656 and 658 at their respective ends 652 and 654 for ease of fabrication and to facilitate the close spacing between adjacent peripheral bores 656 or 658. As described in more detail below, the peripheral bores 656 and 658 circumscribe the cross-section of the target cavity 420 (FIG. 4) in close proximity therewith and run in the lateral direction toward the front side of the target 200. From FIGS. 3 and 6, it can be seen that each individual groove 344 splits the coolant input flow from the elongated slot 342 (FIG. 3) into two flows that run in opposite transverse directions to respective peripheral bores 656 and 658 located at the first groove end 652 and second groove end 654. Assuming the width of the elongated slot 342 is uniform as illustrated in FIG. 3 and the elongated slot 342 is positioned centrally between the first groove ends 652 and the second groove ends 654, each groove 344 may split the coolant input flow generally evenly into the two transverse directions. In alternative implementations, the width and/or the position of the elongated slot 342 may vary along the longitudinal axis B to consequently vary the flow of coolant into various grooves 344 and corresponding peripheral bores 656 and 658. The coolant flow rate into at least one of the plurality of parallel grooves 344 can thereby be made different from the coolant flow rate into at least one other groove 344.

In the illustrated example in which fourteen grooves 344 are provided, the fourteen coolant flow paths entering the grooves 344 are thus divided into twenty-eight transverse coolant flow paths. In the illustrated example in which some of the groove ends 652 and 654 include more than one peripheral bore 656 or 658, additional flow splitting occurs. Specifically, the present example includes twenty-eight groove ends 652 and 654 but thirty-six peripheral bores 656 and 658. Thus, some of the twenty-eight flow paths running transversely to the twenty-eight groove ends 652 and 654 are further divided. As a result, a total of thirty-six coolant flow paths are provided in the corresponding peripheral bores 656 and 658 in the present example. The thirty-six coolant flow paths run through the peripheral bores 656 and 658 in the lateral direction in close proximity to each other and to the target cavity 420, thereby enabling a highly efficient means for removing heat from the target material in the target cavity 420. In other implementations, the number of coolant flow paths running in the various directions described herein may be different, the presently illustrated implementation being but one example.

In some examples, the thickness of each groove wall 646 (in the longitudinal direction) ranges from 0.002 to 0.125 inch. The cross-sectional area of each groove 344 may be defined by the width of the groove 344 in the transverse direction and the height of the groove 344 in the longitudinal direction (between adjacent groove walls 646). In some examples, the height of each groove 344 ranges from 0.01 to 0.125 inch. In some examples, the diameter of each peripheral bore 656 and 658 ranges from 0.01 to 0.25 inch.

In the example illustrated in the FIG. 6, the peripheral bores 656 and 658 may generally be divided into a first set associated with the first groove ends 652 and a second set associated with the second groove ends 654. In each first or second set, the peripheral bores 656 and 658 are closely spaced with each other to maximize the amount of "coverage" of the target cavity 420 and thus the amount of surface area of the peripheral bores 656 and 658 available for transferring heat from the target cavity 420. In some examples, the gap or spacing 648 between any pair of adjacent peripheral bores 656 or 658 of the first or second set ranges from 0.002 to 0.125 inch. The minimal amount of target structure between adjacent peripheral bores 656 or 658 result in the dense coverage of the target cavity discussed above.

It will be noted that in FIG. 6 the uppermost peripheral bore 656 of the first set is spaced at a greater distance from the uppermost peripheral bore 658 of the second set (across the longitudinal axis B) in comparison to the spacing 648 between adjacent peripheral bores 656 or 658 of the first or second set. The same may be said for the respective lowermost peripheral bores 656 or 658 of the first and second sets. This additional spacing is done in the present implementation merely to accommodate the location of the target material inlet bore and outlet bore, which by example are respectively positioned at the top and bottom of the target cavity 420 as shown in FIGS. 3-5 and 10. It will be understood, however, that in other implementations the target material inlet bore and outlet bore may be located in other positions whereby additional spacing between any two adjacent peripheral bores 656 or 658 occurs at a different location or not at all. Apart from the foregoing, the division of the peripheral bores 656 and 658 into first and second sets is conceptual and done for illustrative purposes.

Figure 7:
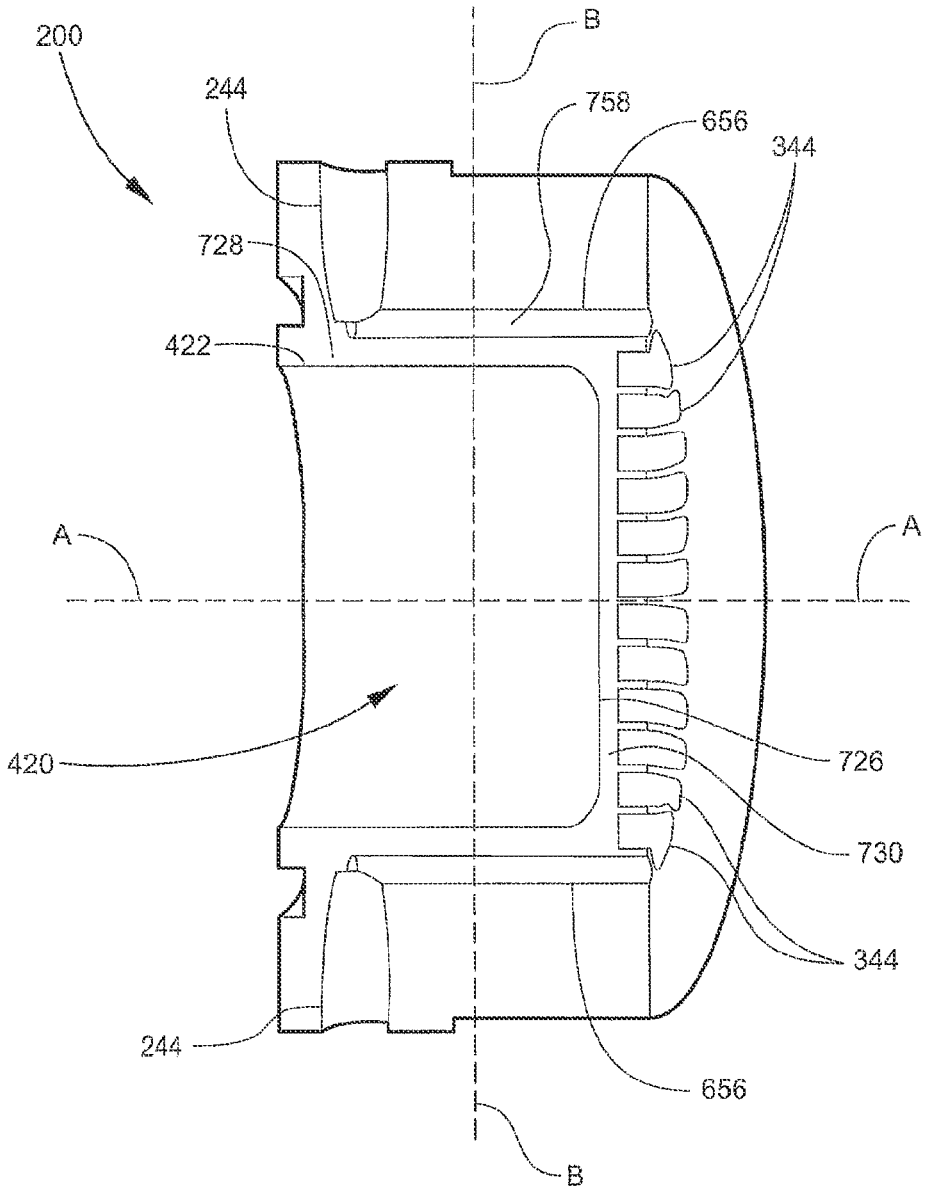
FIG. 7 is a perspective, cross-sectional view of the target that has been cut-away at a plane that reveals peripheral bores fluidly interconnecting respective grooves and radial outflow bores.

FIG. 7 is a perspective, cross-sectional view of the target that has been cut-away at a plane of the lateral axis A and longitudinal axis B that reveals two of the peripheral bores 656 fluidly interconnecting respective grooves 344 and radial outflow bores 244. The target cavity 420 is bounded by the lateral inner wall 422 and an adjoining back inner wall 726. The lateral inner wall 422 is adjacent to the circumferentially surrounding peripheral bores 656 and separated from the peripheral bores 656 by a relatively small distance through an annular portion 728 of the target structure. In some examples, the annular portion 728 has a thickness (in any radial direction relative to the lateral axis A) ranging from 0.002 to 0.5 inch. In other non-limiting examples, the thickness of the annular portion 728 ranges from 0.005 to 0.15 inch. In the illustrated example, the peripheral bores 656 run parallel to the lateral inner wall 422 such that the thickness of the annular portion 728 is uniform along the lateral direction. In alternative implementations, however, the peripheral bores 656 and/or the lateral inner wall 422 may be oriented such that this parallelism is not maintained. In the illustrated example, the series of peripheral bores 656 largely spans the entire extent of the area of the lateral inner wall 422 coaxially about the lateral axis A (see also FIG. 6). Consequently, the peripheral bores 656 collectively provide a large surface area for transferring heat from the lateral inner surface 422, through the annular portion 728, and to the coolant flowing through the peripheral bores 656. Each peripheral bore 656 is bounded by an inner peripheral bore wall 758 that extends from the corresponding groove 344 to the corresponding radial outflow bore 244. Each inner peripheral bore wall 758 has a surface area, and the total surface area of the plurality of peripheral bores 656 may be defined as the summation of the surface areas of the individual inner peripheral bore walls 758.

As also shown in FIG. 7, the back inner wall 726 of the target cavity 420 is adjacent to the grooves 344 and separated from the grooves 344 by a relatively small distance through a back (or longitudinal) portion 730 of the target structure. In some examples, the back portion 730 has a thickness (in the lateral direction, over at least a majority of the grooves 344) ranging from 0.002 to 0.5 inch. In the illustrated example, the series of parallel grooves 344 spans beyond the extent of the area of the back inner wall 726 to facilitate maximizing coverage of the target cavity 420 by the peripheral bores 656, although in other examples may span at least a majority of the area of the back inner wall 726. Moreover, the transverse groove walls or septa 646 (FIG. 6) are thin. Consequently, the grooves 344 collectively provide a large surface area for transferring heat from the back inner wall 726, through the back portion 730, and to the coolant flowing through the grooves 344. The total cross-sectional area of the plurality of grooves 344 may be defined as the summation of the cross-sectional areas of the individual grooves 344.

As noted above, each groove 344 generally defines two coolant flow paths running along the transverse direction, with one coolant flow path running to the peripheral bore(s) 656 located at one groove end 652 (FIG. 6) and the other coolant flow path running the opposing peripheral bore(s) 658 located at the other groove end 654 of the same groove 344. Each coolant flow path then takes an orthogonal turn into a corresponding peripheral bore 656 or 658 and runs in the lateral direction, again in close proximity to the target cavity 420. Thus, the coolant continues to remove heat from the target cavity 420 as it flows toward the front side of the target 200 along the lateral flow paths. To maximize heat removal, the peripheral bores 656 and 658 may extend over a large majority of the depth of the target cavity 420. Each peripheral bore 656 and 658 runs to at least one radial outflow bore 244. The radial outflow bores 244 may be sized (e.g., cross-sectional flow area) larger than the peripheral bores 656 and 658 and positioned such that more than one peripheral bore 656 and 658 terminates at the same radial outflow bore 244. Thus, the number of radial outflow bores 244 may be equal to or less than the number of peripheral bores 656 and 658. This configuration also minimizes the pressure drop in the radial outflow bores 244. The cross-sectional flow area of each radial outflow bore 244 may progressively increase along the radial direction from the end of the peripheral bore 656 or 658 to the outer lateral wall 210 of the target structure, as illustrated in FIG. 7.

Once the coolant reaches a radial outflow bore 244, the coolant then takes an orthogonal turn into the radial outflow bore 244. The coolant then runs in a radial outward direction to the end of the radial outflow bore 244 at the lateral outer surface 210 of the target 200. While flowing in the radial outflow bore 244, the coolant continues to pick up heat energy. In the illustrated example, the radial outflow bores 244 are located in close proximity to the front side of the target 200 that receives the particle beam 114 (FIG. 1), in closer proximity to the front side than to the back side. In some non-limiting examples, the radial outflow bores 244 are located at a distance from the front side along the lateral axis A ranging from 0.01 to 0.5 inch. Moreover, the radial outflow bores 244 are dimensioned so as to provide a large surface area available for heat transfer from the structural (solid) body constituting the target 200. By this configuration, the coolant flowing through the radial outflow bores 244 is able to remove heat from the structural target body as well as from the target material being irradiated in the target cavity 420. Upon reaching the lateral outer surface of the target 200, the coolant may then be flowed away from the target 200 and recirculated back to the grooves 344 in the manner described above.

It thus can be seen that both the grooves 344 on the back side of the target 200 and the peripheral bores 656 and 658 running through the depth of the target 200 cover the inside surfaces of the target cavity 420 very densely and with a minimum of wall thickness between the coolant and the target cavity 420. The radial outflow bores 244 provide additional heat-removing capacity in the manner described above. Moreover, the transverse grooves 344, peripheral bores 656 and 658 and radial outflow bores 244 are dimensioned and positioned in a configuration that maintains a high-velocity coolant flow through the target 200 from input to output, thereby enabling the coolant to rapidly carry away the heat being deposited by the particle beam 114 (FIG. 1). This foregoing configuration therefore maximizes heat removal from the target cavity 420.

Figure 8:
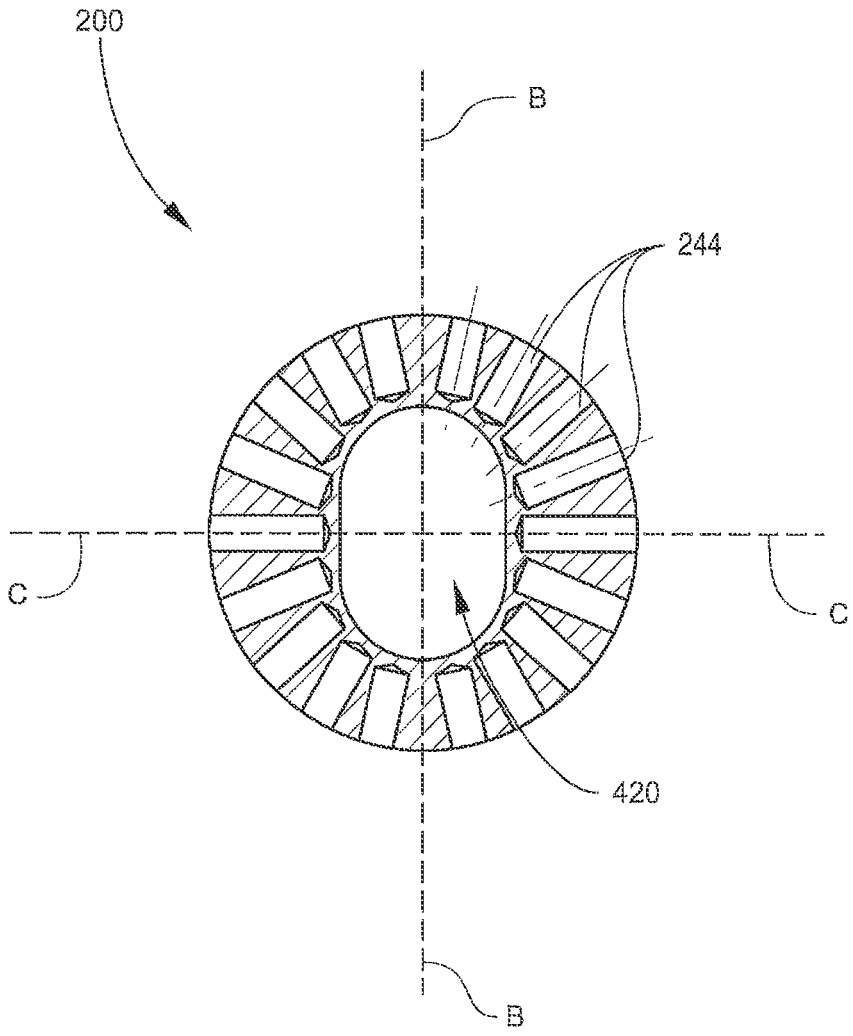
FIG. 8 is a cross-sectional elevation view of the target that has been cut-away at a plane that reveals the radial outflow bores.

FIG. 8 is a cross-sectional elevation view of the target 200 that has been cut-away at a plane of the longitudinal axis B and transverse axis C that reveals the radial outflow bores 244. For reference purposes, the center of the target 200 is taken to be the geometrical center of the target cavity 420, and the origin of the intersecting lateral axis A, longitudinal axis B and transverse axis C has been located at this center. Utilizing this frame of reference, each radial outflow bore 244 is located along a radius projected from the center. As noted above, one or more of the radial outflow bores 244 may fluidly communicate with more than one peripheral bore 656 or 648 (FIG. 7). In the illustrated example, each radial outflow bore 244 communicates with two peripheral bores 656 or 658. Thus, the thirty-six lateral coolant flow paths running through the respective peripheral bores 656 and 658 are reduced to eighteen radial coolant flow paths in the eighteen radial outflow bores 244 illustrated in FIG. 8.

Figure 9:
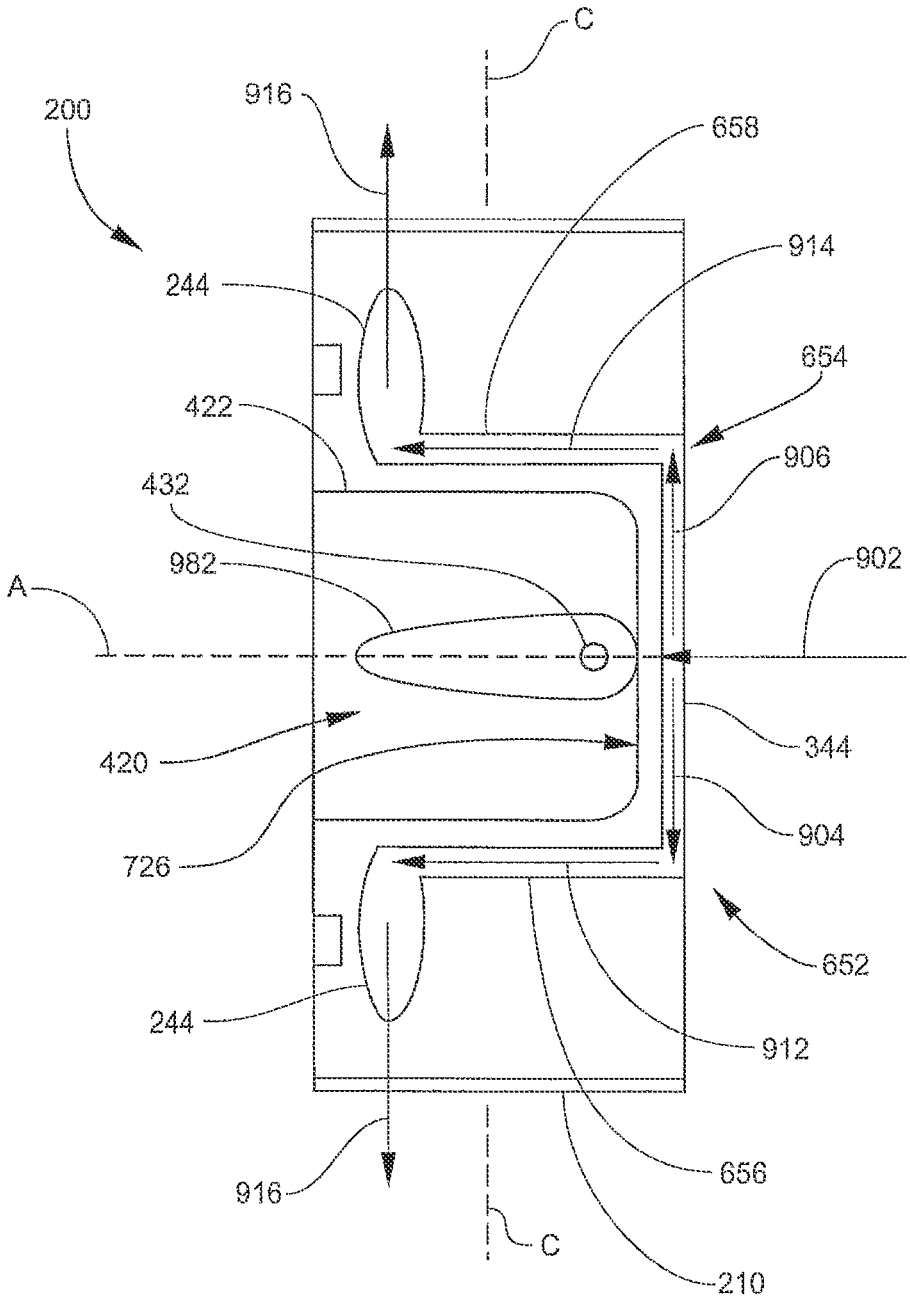
FIG. 9 is a cross-sectional elevation view of the target that has been cut-away at a plane that reveals one of the grooves in fluid communication with a corresponding pair of peripheral bores and radial outflow bores.

FIG. 9 is a cross-sectional elevation view of the target 200 that has been cut-away at a plane of the lateral axis A and transverse axis C that reveals one of the grooves 344 in fluid communication with a corresponding pair of peripheral bores 656 and 658 and radial outflow bores 244. Once an input flow of coolant to the back side of the target 200 is established, the resulting coolant flow paths may be summarized as follows. Initially, the coolant is flowed to the grooves 344 generally along the lateral direction, as indicated by an arrow 902. The coolant input flow 902 encounters the grooves 344 in close proximity with back inner wall 726 of the target cavity 420, and thus the coolant is able to immediately begin removing heat from the target cavity 420. When the input flow 902 encounters the grooves 344, the input flow 902 is initially divided along the longitudinal direction into each groove 344. Thus, each groove 344 is associated with a coolant input flow path 902 separate from the other grooves 344. The grooves 344 are orthogonal to the initial input flow 902. Thus, in each groove 344 the input flow 902 is further divided such that one part of the input flow 902 is diverted to one groove end 652 while the other part of the input flow 902 is diverted to the opposing groove end 654 of the same groove 344. The resulting two transverse coolant flow paths in the groove 344 are indicated by arrows 904 and 906. When each transverse coolant flow 904 and 906 reaches a groove end 652 or 654, that transverse coolant flow 904 and 906 is then diverted orthogonally into the peripheral bore 656 or 658 located at that groove end 652 or 654 (or one of the peripheral bores 656 or 658 in the case where more than one peripheral bore 656 or 658 is formed at a single groove end 652 or 654). The resulting lateral coolant flow paths are indicated by arrows 912 and 914. The lateral coolant flows 912 and 914 then run through the respective peripheral bores 656 and 658 to the corresponding radial outflow bores 244. As coolant is fed into the radial outflow bores 244, it is diverted into corresponding radial coolant outflow paths as indicated by arrows 916. The coolant in each radial outflow bore 244 reaches the outer lateral wall 210 of the target 200 and is conducted away to an external heat exchanging device as described previously in this disclosure.

FIG. 9 may be considered as showing the top end of the target cavity 420 at which the target material inlet bore 432 is located by example (or where the outlet bore may be located in another example). Alternatively, FIG. 9 may be considered as showing the bottom end of the target cavity 420 at which the target material outlet bore (or inlet bore 432) is located. The following description will refer to the target material inlet bore 432, as located at the top end in the present example, with the understanding that the discussion may also apply to the target material outlet bore and/or to the bottom end of the target cavity 420. In the illustrated implementation, the inlet bore 432 is surrounded by an inlet pocket or depression 982 formed in the lateral inner wall 422 of the target cavity 420. The inlet pocket 982 may have any size and shape suitable for complete filling of the target cavity 420. The length of the inlet pocket 982 in the lateral direction may be elongated relative to the width of the inlet pocket 982 in the transverse direction. In the present example, the inlet pocket 982 is elongated in the lateral direction and the width of the inlet pocket 982 in the transverse direction gradually tapers down (decreases) in the lateral direction toward the front side of the target 200. The target material inlet bore 432 is located in the region of the inlet pocket 982 having the maximum width. The resulting "teardrop" shape of the inlet pocket 982, with the target material inlet bore 432 located in the bulk of the teardrop, has been found to be effective for complete filling of the target cavity 420. Likewise, an outlet pocket (not shown) may surround the outlet bore, and may have any size and shape suitable for complete recovery of target material. In the present example, the outlet pocket may be sized and shaped similarly to the illustrated inlet pocket 982.

Figure 10:
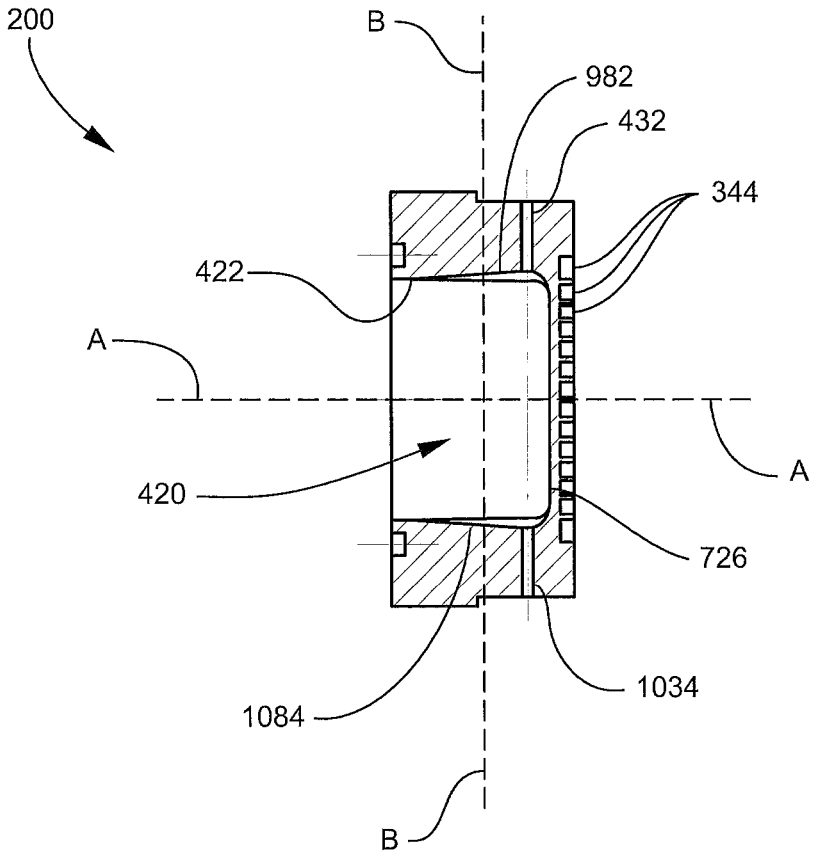
FIG. 10 is a cross-sectional elevation view of the target that has been cut-away at a plane that reveals a target material inlet bore and outlet bore.

FIG. 10 is a cross-sectional elevation view of the target 200 that has been cut-away at a plane of the lateral axis A and longitudinal axis B that reveals the target material inlet bore 432 and an outlet bore 1034. In this example, the inlet bore 432 fluidly communicates with an inlet pocket 982 as described above, and the outlet bore 1034 fluidly communicates with an outlet pocket 1084. As noted above, the respective sizes and shapes of the inlet pocket 982 and the outlet pocket 1084 may be the same or different. In the illustrated example, the above-noted tapering of each pocket 982 and 1084 also occurs along the longitudinal axis A, with each pocket 982 and 1084 being deepest in the vicinity of the inlet bore 432 or outlet bore 1034.

Figure 11:
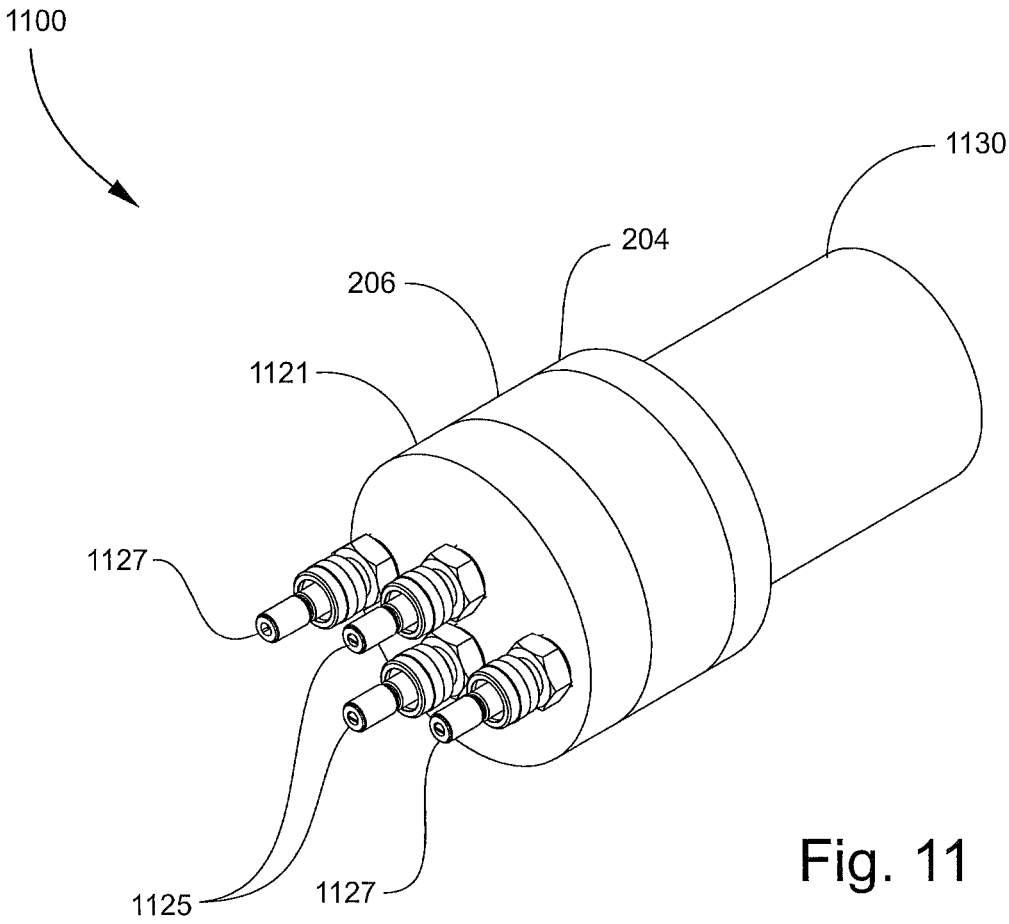
FIG. 11 is a perspective view of an example of a target assembly in which the target may be included.
Figure 12:
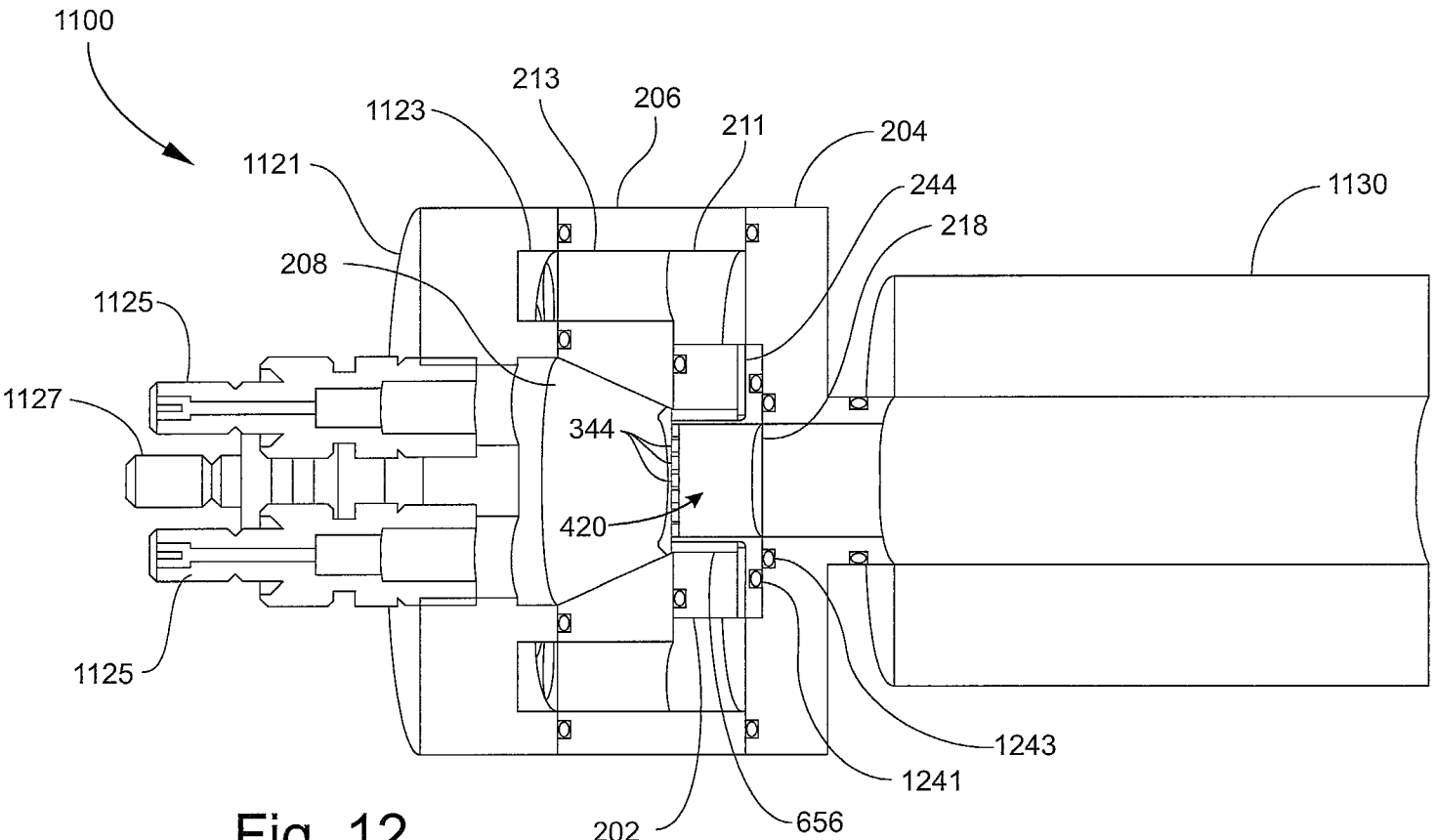
FIG. 12 is a cross-sectional view of the target assembly illustrated in FIG. 11.

FIG. 11 is a perspective view of an example of a target assembly 1100 in which the target 200 may be included, and FIG. 12 is a cross-sectional view of the target assembly 1100. The target assembly 1100 may be utilized in a radionuclide production system such as illustrated by example in FIG. 1, or in other, differently configured radionuclide production systems. The target assembly 1100 generally includes the front target section 204 and the medial target section 206 as described above. In addition, the target assembly 1100 in this example includes a back target section 1121. The back target section 1121 may include a chamber 1123 (FIG. 12) that serves as part of the output plenum for carrying away heated output coolant from the target body 202. The back target section 1121 may also include bores communicating with respective coolant input fittings 1125 and coolant output fittings 1127. In the present example, the coolant input fittings 1125 communicate with the input plenum 208 and the coolant output fittings 1127 communicate with the chamber 1123 of the output plenum. The target assembly 1100 may also include a beam guide 1130 for directing a particle beam from a particle beam source (e.g., the particle beam source 140 shown in FIG. 1) to the target window 218 (FIG. 12).

As also shown in FIG. 12, various adjacent components of the target assembly 1100 may be fluidly sealed by sealing elements (e.g., o-rings, gaskets, etc.) seated in grooves or channels formed in or on such components. In particular, the arrangement of the target window 218 interposed between the target body 202 and the front target section 204 may be fluidly sealed by a sealing element seated in a channel 1241 formed in the front side of the target body 202, and/or by a sealing element seated in a channel 1243 formed in the front target section 204. Generally, the target window 218 may have any shape and planar size, so long as the outer diameter (or other relevant dimension, more generally perimeter) of the target window 218 is large enough that the target window 218 covers the opening of the target cavity 420. In practice, the outer perimeter of the target window 218 is large enough to accommodate the use of fluid sealing means such as the illustrated sealing element/channel 1241 and/or 1243. FIG. 12 illustrates one non-limiting example in which the area of the target window 218 is coextensive with that of the front side of the target body 202.

Continuing with FIG. 12, the location of the peripheral bores 656 in relation to the target cavity 420, as well as to other components of the target 200 and associated target assembly 1100, optimizes the ability of the coolant circulating through the target 200 to remove heat from the target 200. The peripheral bores 656 closely surround the target cavity 420 and span most of the axial depth of the target cavity 420 to maximize the amount of heat transfer therefrom. Relative to the lateral axis running through the target cavity 420, the peripheral bores 656 are arranged about a perimeter at a radial distance not much greater than the radial extent of the target cavity 420. This arrangement of the peripheral bores 656 may be characterized in relation to the target window 218 and the associated sealing element/channel 1241 and/or 1243. It can be seen that the perimeter of the peripheral bores 656 is less that the outer perimeter of the target window 218. Stated in another way, the area taken up by the arrangement of peripheral bores 656 is within the area of the target window 218. Additionally or alternatively, the perimeter of the peripheral bores 656 is less that the perimeter of the sealing element/channels 1241 and 1243. This arrangement of the peripheral bores 656 is facilitated by the provision of the radial outflow bores 244, which allow the peripheral bores 656 to run close to the target cavity 420 and close up to the target window 218. Additionally, the radial outflow bores 244 maximize heat removal from the target window 218 and the region of the target body 202 proximal to the target window 218

Figure 13:
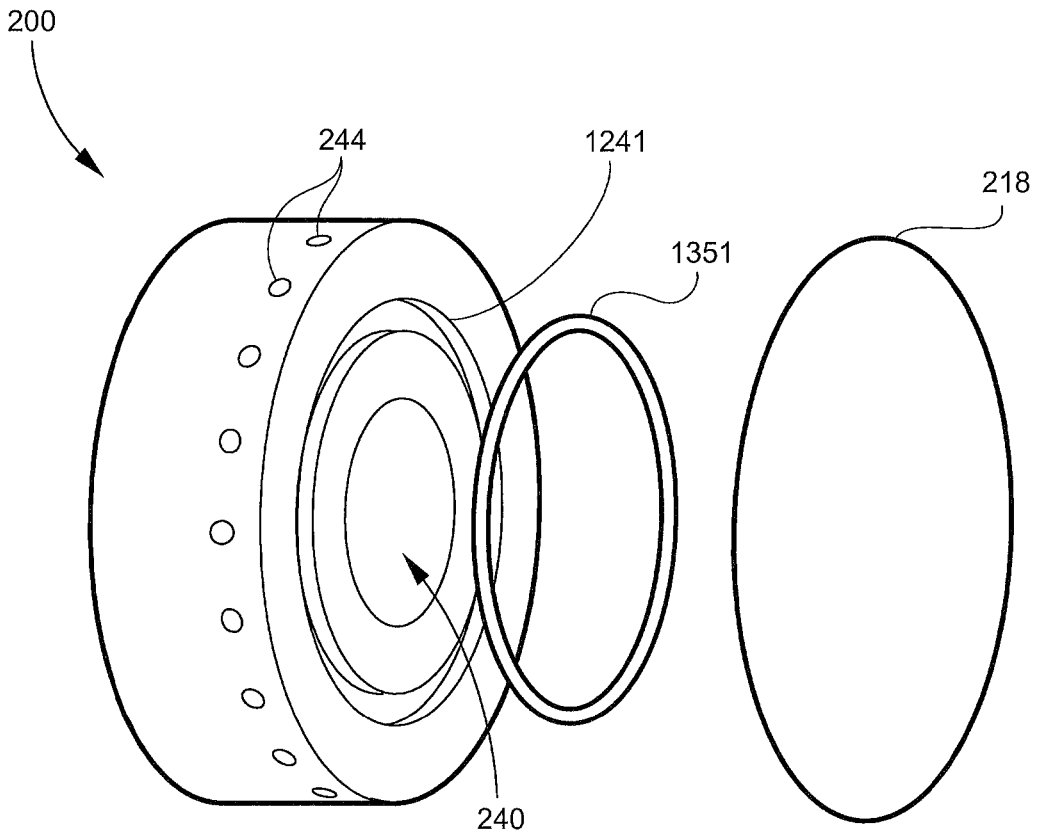
FIG. 13 is an exploded perspective view of the target and an associated sealing element and target window.
Figure 14:
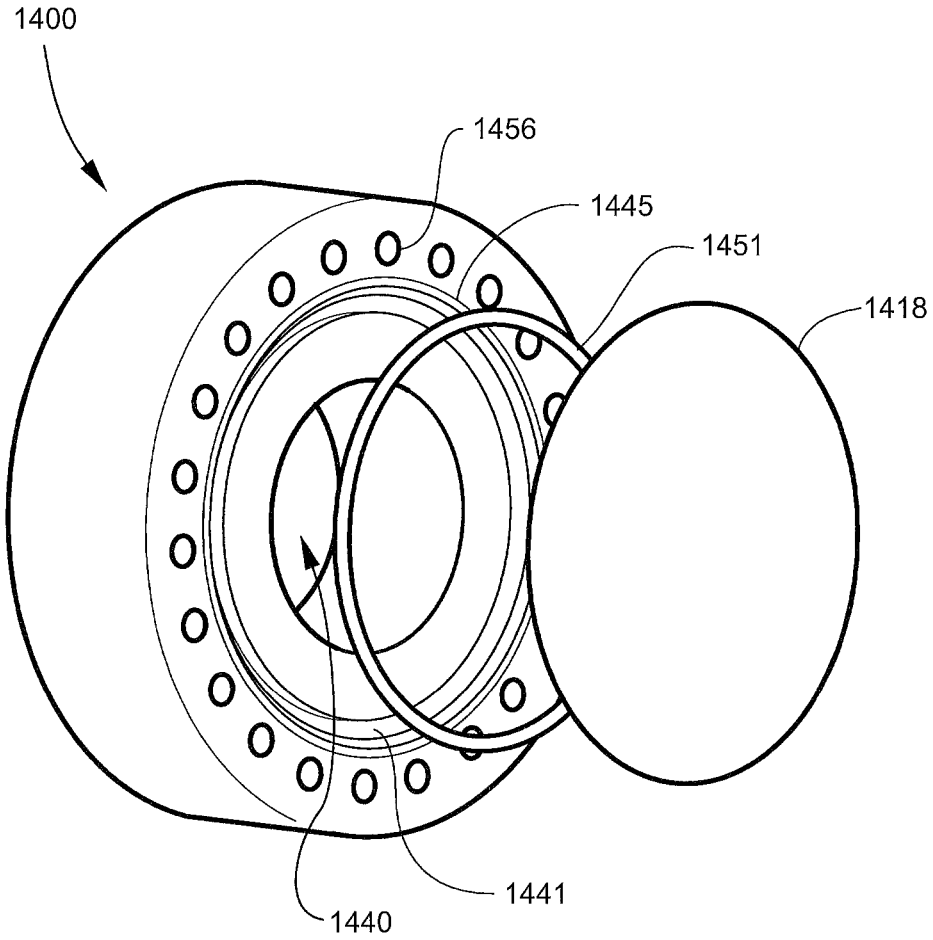
Fig. 14 (Prior Art)
FIG. 14 is an exploded perspective view of a conventional design of a target and associated sealing element and target window.

The advantages provided by the present teachings may be further illustrated by comparing FIGS. 13 and 14. FIG. 13 is an exploded perspective view of the target 200, a sealing element 1351, and the target window 218. The peripheral bores 656 (FIG. 12) may be placed within the perimeter of the channel 1241 in which the sealing element 1351 is seated, as well as within the perimeter of the target window 218. Coolant from the peripheral bores 656 is carried away by the radial outflow bores 244, enabling the peripheral bores 656 to be immediately adjacent to the target cavity 240. FIG. 13 also shows an alternative circular cross-section for the target cavity 240. By contrast, FIG. 14 is an exploded perspective view of a conventional design of a target 1400 and its associated sealing element 1451 and target window 1418. In FIG. 14, the sealing element 1451 is seated in a recess 1441 formed in the target body and the target window 1418 is mounted in another recess 1445 concentrically surrounding the sealing element recess 1441. This conventional target 1400 has a radial distribution of axial bores 1456 for conducting coolant from the back side to the front side of the target 1400. These axial bores 1456, however, must be arranged far away from the target cavity 1440 to avoid the target window 1418 and the sealing element 1451. Hence, the axial bores 1456 are located outside the perimeter of both the sealing element recess 1441 and the target window 1418.

In general, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A particle beam target, comprising:

a target body that receives coolant via a coolant inlet, the target body including a front side, a back side, and a lateral outer wall extending from the front side to the back side;

a target cavity disposed in the target body configured such that a particle beam can be directed into the target cavity via a target window, the target cavity including a back inner wall, a lateral inner wall, and a cross-section bounded by the lateral inner wall, the back inner wall spaced from the back side relative to a lateral axis, and the lateral inner wall extending from the back inner wall toward the front side generally along the direction of the lateral axis;

a plurality of parallel grooves formed in the back side, each groove including a first groove end and a second groove end and running along a transverse direction from the first groove end to the second groove end, the transverse direction being orthogonal to the lateral axis;

a plurality of peripheral bores extending through the target body from the plurality of grooves toward the front side, the peripheral bores arranged to circumscribe the target cavity cross-section in proximity to the lateral inner wall, wherein each groove fluidly communicates with at least one peripheral bore at the first groove end and at least one other peripheral bore at the second groove end; and a plurality of radial outflow bores extending in respective radial directions relative to the lateral axis from the plurality of peripheral bores to the lateral outer wall, each radial outflow bore fluidly communicating with at least one of the peripheral bores, wherein the target body defines a plurality of separate liquid coolant flow paths, each liquid coolant flow path running from a respective groove to at least one of the first groove end and the second groove end of the groove, through at least one peripheral bore, and through at least one radial outflow bore to the lateral outer wall.

2. The particle beam target of claim 1, further comprising a target material inlet bore extending through the target body and into fluid communication with the target cavity.

3. The particle beam target of claim 2, wherein the target cavity has an inlet pocket formed in the lateral inner wall and circumscribing the target material inlet bore.

4. The particle beam target of claim 3, wherein the inlet pocket has a lateral dimension running in a direction generally toward the front side and a width transverse to the lateral dimension, and the width decreases along the lateral dimension in a direction away from the target material inlet bore.

5. The particle beam target of claim 3, wherein the inlet pocket has a lateral dimension running in a direction generally toward the front side and a width transverse to the lateral dimension, and the lateral dimension is elongated relative to the width.

6. The particle beam target of claim 1, further comprising a target material outlet bore extending radially through the target body from the target cavity to the lateral outer wall.

7. The particle beam target of claim 6, wherein the target cavity has an outlet pocket formed in the lateral inner wall and circumscribing the target material outlet bore.

8. The particle beam target of claim 1, wherein at least one of the plurality of parallel grooves fluidly communicates with more than one peripheral bore at the first groove end and more than one other peripheral bore at the second groove end, and the number of grooves is less than half of the number of peripheral bores.

9. The particle beam target of claim 1, wherein at least one of the plurality of radial outflow bores fluidly communicates with more than one peripheral bore, and the number of radial outflow bores is less than the number of peripheral bores.

10. The particle beam target of claim 1, wherein the cross-sectional flow area of each peripheral bore is less than the cross-sectional flow area of each radial outflow bore.

11. The particle beam target of claim 1, wherein each groove has a cross-sectional area defined by a width of the groove in the transverse direction and a height of the groove in a direction orthogonal to the transverse direction, and the height of the groove ranges from 0.01 inch to 0.125 inch.

12. The particle beam target of claim 1, wherein the target body includes a back portion disposed between the back inner wall and at least a majority of the plurality of grooves, and the back portion has a thickness along the lateral axis ranging from 0.002 inch to 0.5 inch.

13. The particle beam target of claim 1, wherein each groove is separated from at least one other adjacent groove by a groove wall, and the groove wall has a thickness between the adjacent grooves ranging from 0.002 inch to 0.125 inch.

14. The particle beam target of claim 1, wherein the target body includes an annular portion disposed between the lateral inner wall and the plurality of peripheral bores, and the annular portion has a thickness in a radial dimension relative to the lateral axis ranging from 0.002 inch to 0.5 inch.

15. The particle beam target of claim 1, wherein the plurality of radial outflow bores are located closer to the front side than to the back side.

16. The particle beam target of claim 1, wherein the plurality of radial outflow bores are located at a distance from the front side along the lateral axis ranging from 0.01 inch to 0.5 inch.

17. The particle beam target of claim 1, wherein the target cavity has a depth along the lateral axis, and the plurality of peripheral bores extend from the plurality of grooves along at least a majority of the depth.

18. The particle beam target of claim 1, wherein each peripheral bore has a diameter ranging from 0.01 inch to 0.25 inch.

19. The particle beam target of claim 1, wherein the plurality of peripheral bores extend in a direction parallel to the lateral inner wall.

20. The particle beam target of claim 1, wherein the plurality of peripheral bores include a first set of peripheral bores communicating with the first groove ends of the respective grooves and a second set of peripheral bores communicating with the second groove ends of the respective grooves, and each peripheral bore is spaced from an adjacent peripheral bore in the same first or second set by a distance ranging from 0.002 inch to 0.125 inch.

21. The particle beam target of claim 1, further comprising a coolant inlet body abutting the back side and covering the plurality of peripheral bores, the coolant inlet body including an elongated slot fluidly communicating with each of the grooves, wherein the coolant inlet body defines a liquid coolant inlet flow path running through the elongated slot and into each of the grooves such that the liquid coolant inlet flow path branches into each of the liquid coolant flow paths, and each liquid coolant flow path is divided into a first liquid coolant flow path running to the first groove end and a second liquid coolant flow path running to the second groove end.

22. The particle beam target of claim 21, wherein the elongated slot is positioned at a point over each groove equidistant to the first groove end and to the second groove end of the groove, and the coolant flow in the liquid coolant flow path for the respective groove is divided approximately equally into the first liquid coolant flow path and the second liquid coolant flow path.

23. The particle beam target of claim 21, wherein the elongated slot has a cross-sectional flow area defined by a length along which the slot is elongated and a width orthogonal to the length, and the width is non-uniform such that the coolant flow rate into at least one of the plurality of grooves is different than the coolant flow rate into at least one other groove.

24. A particle beam target, comprising:

a target body that receives coolant via a coolant inlet, the target body including a front side, a back side, and a lateral outer wall extending from the front side to the back side;

a target cavity disposed in the target body configured such that a particle beam can be directed into the target cavity via a target window, the target cavity bounded by a lateral inner wall of the target body, the lateral inner wall disposed about a lateral axis and extending from a target cavity opening at the front side toward the back side;

a channel formed at the front side and circumscribing the target cavity opening;

a plurality of peripheral bores extending through the target body from the back side toward the front side, the peripheral bores circumscribing the target cavity in proximity to the lateral inner wall, wherein the peripheral bores are arranged along a peripheral bore perimeter at a radial distance between the target cavity and the channel relative to the lateral axis; and a plurality of radial outflow bores extending in respective radial directions relative to the lateral axis from the plurality of peripheral bores to the lateral outer wall, each radial outflow bore fluidly communicating with at least one of the peripheral bores, wherein the target body defines a plurality of separate liquid coolant flow paths, each liquid coolant flow path running from the back side of the target body, through at least one peripheral bore, and through at least one radial outflow bore to the lateral outer wall.

25. The particle beam target of claim 24, further comprising a plurality of parallel grooves formed in the back side, each groove including a first groove end and a second groove end and running along a transverse direction from the first groove end to the second groove end, the transverse direction being orthogonal to the lateral axis, wherein each liquid coolant flow path running from a respective groove to at least one of the first groove end and the second groove end of the groove, through at least one peripheral bore, through at least one radial outflow bore, and to the lateral outer wall.

26. The particle beam target of claim 25, wherein at least one of the plurality of parallel grooves fluidly communicates with more than one peripheral bore at the first groove end and more than one other peripheral bore at the second groove end, and the number of grooves is less than half of the number of peripheral bores.

27. The particle beam target of claim 25, further comprising a coolant inlet body abutting the back side and covering the plurality of peripheral bores, the coolant inlet body including an elongated slot fluidly communicating with each of the grooves, wherein the coolant inlet body defines a liquid coolant inlet flow path running through the elongated slot and into each of the grooves such that the liquid coolant inlet flow path branches into each of the liquid coolant flow paths, and each liquid coolant flow path is divided into a first liquid coolant flow path running to the first groove end and a second liquid coolant flow path running to the second groove end.

28. The particle beam target of claim 24, wherein at least one of the plurality of radial outflow bores fluidly communicates with more than one peripheral bore, and the number of radial outflow bores is less than the number of peripheral bores.

29. The particle beam target of claim 24, wherein the target body includes an annular portion disposed between the lateral inner wall and the plurality of peripheral bores, and the annular portion has a thickness in a radial dimension relative to the lateral axis ranging from 0.002 inch to 0.5 inch.

30. The particle beam target of claim 24, wherein the plurality of radial outflow bores are located closer to the front side than to the back side.

31. The particle beam target of claim 24, wherein the target cavity has a depth along the lateral axis, and the plurality of peripheral bores extend from the plurality of grooves along at least a majority of the depth.

32. A particle beam target, comprising:

a target body that receives coolant via a coolant inlet, the target body including a front side, a back side, and a lateral outer wall extending from the front side to the back side;

a target cavity disposed in the target body configured such that a particle beam can be directed into the target cavity via a target window, the target cavity bounded by a lateral inner wall of the target body, the lateral inner wall disposed about a lateral axis and extending from a target cavity opening at the front side toward the back side;

a plurality of peripheral bores extending through the target body from the back side toward the front side and circumscribing the target cavity, wherein the target body further includes an annular portion interposed between the lateral inner wall and the peripheral bores, and the annular portion has a radial thickness between the lateral inner wall and the peripheral bores ranging from 0.002 inch to 0.5 inch; and a plurality of radial outflow bores extending in respective radial directions relative to the lateral axis from the plurality of peripheral bores to the lateral outer wall, each radial outflow bore fluidly communicating with at least one of the peripheral bores, wherein the target body defines a plurality of separate liquid coolant flow paths, each liquid coolant flow path running from the back side of the target body, through at least one peripheral bore, and through at least one radial outflow bore to the lateral outer wall.

33. The particle beam target of claim 32, further comprising a plurality of parallel grooves formed in the back side, each groove including a first groove end and a second groove end and running along a transverse direction from the first groove end to the second groove end, the transverse direction being orthogonal to the lateral axis, wherein each liquid coolant flow path running from a respective groove to at least one of the first groove end and the second groove end of the groove, through at least one peripheral bore, through at least one radial outflow bore, and to the lateral outer wall.

34. The particle beam target of claim 33, wherein at least one of the plurality of parallel grooves fluidly communicates with more than one peripheral bore at the first groove end and more than one other peripheral bore at the second groove end, and the number of grooves is less than half of the number of peripheral bores.

35. The particle beam target of claim 33, further comprising a coolant inlet body abutting the back side and covering the plurality of peripheral bores, the coolant inlet body including an elongated slot fluidly communicating with each of the grooves, wherein the coolant inlet body defines a liquid coolant inlet flow path running through the elongated slot and into each of the grooves such that the liquid coolant inlet flow path branches into each of the liquid coolant flow paths, and each liquid coolant flow path is divided into a first liquid coolant flow path running to the first groove end and a second liquid coolant flow path running to the second groove end.

36. The particle beam target of claim 32, wherein at least one of the plurality of radial outflow bores fluidly communicates with more than one peripheral bore, and the number of radial outflow bores is less than the number of peripheral bores.

37. The particle beam target of claim 32, wherein the plurality of radial outflow bores are located closer to the front side than to the back side.

38. The particle beam target of claim 33, wherein the target cavity has a depth along the lateral axis, and the plurality of peripheral bores extend from the plurality of parallel grooves along at least a majority of the depth.

39. A particle beam target, comprising:

a target body that receives coolant via a coolant inlet, the target body including a front side, a back side, and a lateral outer wall extending from the front side to the back side;

a target cavity disposed in the target body and bounded by a lateral inner wall of the target body, the lateral inner wall disposed about a lateral axis and extending from a target cavity opening at the front side toward the back side;

a target window disposed at the front side and covering the target cavity opening;

a plurality of peripheral bores extending through the target body from the back side toward the front side, the peripheral bores circumscribing the target cavity in proximity to the lateral inner wall, wherein the peripheral bores are arranged along a peripheral bore perimeter at a radial distance between the target cavity and an outer perimeter of the target window relative to the lateral axis; and a plurality of radial outflow bores extending in respective radial directions relative to the lateral axis from the plurality of peripheral bores to the lateral outer wall, each radial outflow bore fluidly communicating with at least one of the peripheral bores, wherein the target body defines a plurality of separate liquid coolant flow paths, each liquid coolant flow path running from the back side of the target body, through at least one peripheral bore, and through at least one radial outflow bore to the lateral outer wall.

40. The particle beam target of claim 39, further comprising a plurality of parallel grooves formed in the back side, each groove including a first groove end and a second groove end and running along a transverse direction from the first groove end to the second groove end, the transverse direction being orthogonal to the lateral axis, wherein each liquid coolant flow path running from a respective groove to at least one of the first groove end and the second groove end of the groove, through at least one peripheral bore, through at least one radial outflow bore, and to the lateral outer wall.

41. The particle beam target of claim 40, wherein at least one of the plurality of grooves fluidly communicates with more than one peripheral bore at the first groove end and more than one other peripheral bore at the second groove end, and the number of grooves is less than half of the number of peripheral bores.

42. The particle beam target of claim 40, further comprising a coolant inlet body abutting the back side and covering the plurality of peripheral bores, the coolant inlet body including an elongated slot fluidly communicating with each of the grooves, wherein the coolant inlet body defines a liquid coolant inlet flow path running through the elongated slot and into each of the grooves such that the liquid coolant inlet flow path branches into each of the liquid coolant flow paths, and each liquid coolant flow path is divided into a first liquid coolant flow path running to the first groove end and a second liquid coolant flow path running to the second groove end.

43. The particle beam target of claim 39, wherein at least one of the plurality of radial outflow bores fluidly communicates with more than one peripheral bore, and the number of radial outflow bores is less than the number of peripheral bores.

44. The particle beam target of claim 39, wherein the target body includes an annular portion disposed between the lateral inner wall and the plurality of peripheral bores, and the annular portion has a thickness in a radial dimension relative to the lateral axis ranging from 0.002 inch to 0.5 inch.

45. The particle beam target of claim 39, wherein the plurality of radial outflow bores are located closer to the front side than to the back side.

46. The particle beam target of claim 40, wherein the target cavity has a depth along the lateral axis, and the plurality of peripheral bores extend from the plurality of grooves along at least a majority of the depth.

* * * * *